US008961710B2

(12) United States Patent
Neishi et al.

(10) Patent No.: US 8,961,710 B2
(45) Date of Patent: Feb. 24, 2015

(54) CARBURIZED COMPONENT AND MANUFACTURING METHOD

(75) Inventors: Yutaka Neishi, Osaka (JP); Takanari Hamada, Kitakyushu (JP); Hidekazu Sueno, Kitakyushu (JP); Yuji Kobayashi, Toyokawa (JP); Hideaki Sugiura, Toyokawa (JP)

(73) Assignees: Nippon Steel & Sumitomo Metal Corporation, Tokyo (JP); Sintokogio, Ltd., Aichi (JP)

( * ) Notice: Subject to any disclaimer, the term of this patent is extended or adjusted under 35 U.S.C. 154(b) by 0 days.

(21) Appl. No.: 13/304,733

(22) Filed: Nov. 28, 2011

(65) Prior Publication Data

US 2012/0085465 A1 Apr. 12, 2012

Related U.S. Application Data

(63) Continuation of application No. PCT/JP2010/058876, filed on May 26, 2010.

(30) Foreign Application Priority Data

May 27, 2009 (JP) ..... 2009-127175

(51) Int. Cl.

| | |
|---|---|
| ***C23C 8/22*** | (2006.01) |
| ***C23C 8/20*** | (2006.01) |
| ***C21D 1/06*** | (2006.01) |
| ***C21D 7/06*** | (2006.01) |
| ***C21D 9/28*** | (2006.01) |
| ***C21D 9/32*** | (2006.01) |
| ***C21D 9/40*** | (2006.01) |

(Continued)

(52) U.S. Cl.

CPC ... *C23C 8/20* (2013.01); *C21D 1/06* (2013.01); *C21D 7/06* (2013.01); *C21D 9/28* (2013.01); *C21D 9/32* (2013.01); *C21D 9/40* (2013.01); *C23C 8/44* (2013.01); *C23C 8/64* (2013.01)

USPC ..... 148/211; 148/335; 148/334; 148/332; 148/333

(58) Field of Classification Search

USPC ..... 148/211, 335, 334, 332, 333

See application file for complete search history.

(56) References Cited

FOREIGN PATENT DOCUMENTS

| | | |
|---|---|---|
| JP | 64-036779 | 2/1989 |
| JP | 5-140726 | 6/1993 |

(Continued)

OTHER PUBLICATIONS

Machine translation of JP 2008261037, 2008.*

(Continued)

*Primary Examiner* — Rebecca Lee

(74) *Attorney, Agent, or Firm* — Clark & Brody

(57) ABSTRACT

A carburized component with improved fatigue strength has a base steel containing, by mass %, C: 0.15-0.25%, Si: 0.03-0.50%, Mn: more than 0.60% and not more than 1.5%, P≤0.015%, S: 0.006-0.030%, Cr: 0.05-2.0%, Al≤0.10%, N≤0.03%, and O≤0.0020%, and optionally at least one element selected from Mo, Cu, Ni, B, Ti, Nb and V, the balance being Fe and impurities. A surface hardened layer portion satisfies: (a) average carbon concentration in the region from the outermost surface to a point of 0.2 mm depth of 0.35-0.60 mass %, (b) surface roughness Rz≤15 μm, and (c) $\sigma r(\mathbf{0}) \leq -800$ MPa, $\sigma r(\mathbf{100}) \leq -800$ MPa, and residual stress intensity index Ir≤80000, wherein Ir is calculated by $[Ir = \int |\sigma r(y)| dy]$, where y μm is the depth from the outermost surface and σr(y) is the residual stress for the points from the outermost surface to a depth of 100 μm with the range of y from 0 to 100 (μm).

4 Claims, 1 Drawing Sheet

(51) Int. Cl.

| | |
|---|---|
| ***C23C 8/44*** | (2006.01) |
| ***C23C 8/64*** | (2006.01) |
| *C22C 38/32* | (2006.01) |

(56) References Cited

FOREIGN PATENT DOCUMENTS

| | | | |
|---|---|---|---|
| JP | 5-156421 | | 6/1993 |
| JP | 2007-246941 | | 9/2007 |
| JP | 2007-307678 | | 11/2007 |
| JP | 2008-248284 | | 10/2008 |
| JP | 2008-255470 | | 10/2008 |
| JP | 2008-261037 | | 10/2008 |
| JP | 2008297618 A | * | 12/2008 |
| KR | 10-2001-0013891 | | 2/2001 |

OTHER PUBLICATIONS

Ebert "The Role of Residual Stresses in the Mechanical Performance of Case Carburized Steels", Metallurgical and Materials Transactions A, 9 (11), 1978, 1537-1551.*

Natishan et al. "Carbon Surface Modification for Enhanced Corrosion Resistance", Materials Science and Technology, 171-172, 2008.*

Matsushima et al., R&D Kobe Steel Engineering Reports, vol. 50, No. 1 (Apr. 2000), pp. 57-60.

* cited by examiner

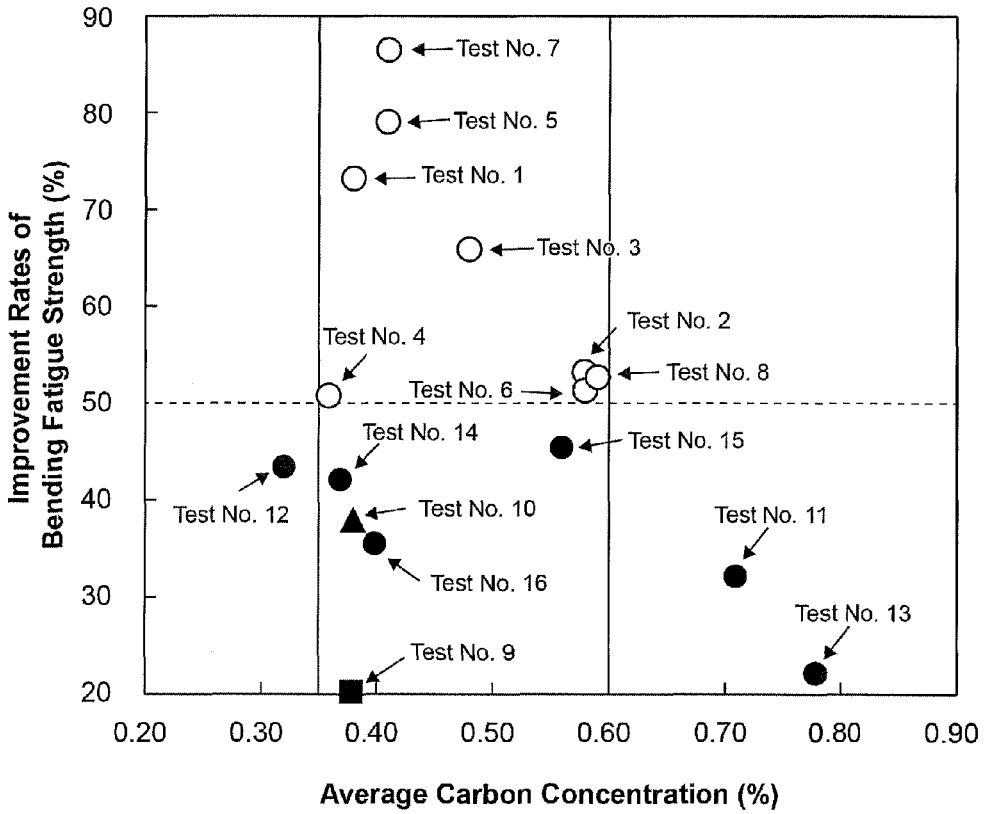
Improvement Rates of Bending Fatigue Strength (%)
90
80
70
60
50
40
30
20
0.20
0.30
0.40
0.50
0.60
0.70
0.80
0.90
Average Carbon Concentration (%)
Test No. 7
Test No. 5
Test No. 1
Test No. 3
Test No. 2
Test No. 8
Test No. 4
Test No. 6
Test No. 14
Test No. 15
Test No. 12
Test No. 10
Test No. 11
Test No. 16
Test No. 13
Test No. 9

CARBURIZED COMPONENT AND MANUFACTURING METHOD

This application is a continuation of the international application PCT/JP2010/058876 filed on May 26, 2010, the entire content of which is herein incorporated by reference.

TECHNICAL FIELD

The present invention relates to a component which has been subjected to carburizing (hereafter, referred to as a "carburized component") and a manufacturing method thereof. To be specific, it relates to high-strength steel carburized components used as various shafts or power transmission parts for automobiles, construction machines, industrial machines, and the like, and a manufacturing method thereof. To be more specific, it relates to high-strength steel carburized components that have improved strength, especially, fatigue strength in a so-called "low to medium cycle region" associated with impulsive loading, that is, "a strength before a fatigue fracture occurs at a number of repetitions of about $10^3$ to $10^4$ cycles when repetitive impulsive loading is applied so as to cause plastic deformation", and a manufacturing method thereof.

BACKGROUND ART

In the course of manufacturing automobile parts, construction machine parts and industrial machinery parts, such as axle shafts, drive shafts, outer races for constant velocity joints, or gears for power transmission, those components are generally subjected to a surface hardening treatment or hardened by normal "quenching and tempering" in order to provide a desired mechanical property after being machined into a prescribed shape.

Particularly for automotive parts among the above described components, there has been an increased demand for reducing size and weight in order to address environmental challenges such as improving the fuel economy and reducing the exhaust emissions of automobiles in recent years. As a result, loading on the components has been more and more increasing and, in particular, it has become important to improve the fatigue strength in the "low to medium cycle region" where impulsive loading is problematic.

In order to enhance the fatigue strength of components, generally, "carburizing and quenching" is often used as a surface hardening treatment.

However, in the case of a normal "carburizing and quenching" treatment, the carbon concentration of the hardened portion of the surface reaches about 0.8% by mass %, and the micro structure after quenching becomes a high-carbon martensite structure. As a result, although a high hardness can be achieved, it is difficult to avoid "embrittlement" caused by the high-carbon martensite structure.

"Martensite" in the present description refers to a structure having a "lath-type structural form" among a so-called "fresh martensite" and a "self-tempered martensite", which are obtained by an isothermal transformation and a continuous cooling transformation, and "tempered martensite" which is obtained by tempering the same, and it also includes a structure in which carbides such as $\epsilon$ or $\theta$ carbide is precipitated in the above described "lath-type structure".

Even in the case of tempering the above described "fresh martensite" and "self-tempered martensite", if tempering is carried out at a high temperature, for example at more than 700° C., which causes the "lath-type structure" to recrystallize to form an equiaxed ferrite, it will not be included in the "tempered martensite".

Non Patent Document 1 describes a study of materials which are assumed to be subjected to a "carburizing and quenching" treatment. However, only with such modification of the material, it is difficult to avoid "embrittlement" caused by the above described high-carbon martensite structure. Thus, it is not sufficient to improve the fatigue strength in the "low to medium cycle region" associated with impulsive loading.

Accordingly, a method of achieving high fatigue strength that is being studied is a method of performing a shot peening treatment after a surface hardening treatment such as carburizing and quenching to provide compressive residual stress on the component's surface. Specifically, for example, Patent Documents 1 to 4 propose a high-fatigue-strength component and a manufacturing method thereof, which combines a surface hardening treatment such as carburizing and quenching, etc. and a shot peening treatment. Patent Document 5 proposes a high-fatigue-strength component and a manufacturing method thereof as another method of achieving high fatigue strength, in which after the surface hardening treatment by carburizing and quenching is carried out, an induction hardening is further performed on a particular location of the product.

That is, Patent Document 1 discloses a "method for manufacturing driving system machine parts having high fatigue strength", wherein steel containing 0.1 to 0.3% of carbon is prepared and shaped into a machine part, and the machine part is subjected to a carburizing or carbonitriding treatment so as to allow a slack quenched layer having a Vickers hardness of not less than 400 and less than 700 to be present in a range of depth from not less than 10 μm to not more than 50 μm from the surface; or wherein steel containing 0.35 to 0.75% of carbon is prepared and shaped into a machine part, and the machine part is subjected to quenching so as to allow a slack quenched layer having a Vickers hardness of not less than 400 and less than 700 to be present in a range of depth from not less than 10 μm to not more than 50 μm from the surface, and further to tempering; and wherein thereafter the machine part is subjected to a shot peening treatment by use of peening media having a hardness of not less than 500 in Vickers hardness.

Patent Document 2 discloses a "production method of carburization hardened product having high fatigue strength" comprising: preparing a steel material which contains, by mass %, C: 0.1 to 0.4%, Si; not more than 0.3%, and Al: 0.02 to 0.08%, also contains two or more kinds of elements selected from a group consisting of Mn; 0.3 to 3.1%, Ni; 0 to 6%, Cr: 0 to 1.2%, and Mo: 0 to 1.2% so as to satisfy [6.4%≤2[Mn]+[Ni]+[Cr]+[Mo]≤8.2%], and further contains, as desired, one or more kinds selected from a group consisting of Nb: 0.005 to 0.2% and V; 0.03 to 0.8%, with the balance being iron and unavoidable impurities; subjecting the steel material to a carburizing or carbonitriding treatment such as one which satisfies [0.55%≤surface carbon content (mass %)+surface nitrogen content (mass %)≤0.90%], and then to a quenching from a single austenite phase region, to obtain steel material whose hardened layer by carburizing and quenching has a maximum hardness of 550 to 620 in Vickers hardness, and wherein an area fraction of retained austenite in a region from the surface to a depth of 300 μm is never be not more than 20%; and thereafter subjecting the steel material to a shot peening treatment under the condition that an arc height is not less than 0.6 mmA.

Patent Document 3 discloses a "component for high interface pressure having excellent pitting resistance and wear resistance", wherein the component is made up of steel containing, by mass %, C: 0.15 to 0.60%, Si: 0.01 to 2.00%, Mn: 0.01 to 2.00%, Al: 0.003 to 0.050%, N: 0.005 to 0.100%, Cr: 1.50 to 6.00%, and Mo: 0.01 to 3.00%, satisfying Cr+2Mo: 2.00 to 8.00%, the steel further containing, as desired, one or two kinds selected from Ni: 0.1 to 2.0%, B: 0.0001 to 0.0020%, V: 0.01 to 0.50%, Nb: 0.01 to 0.20%, and Ti: 0.01 to 0.20%, with the balance being Fe and unavoidable impurities, and wherein an area fraction of carbides is not more than 2% in a surface layer, where the square root of the product of the major axis and the minor axis of each carbide is not less than 2 μm; and a "production method of component for high interface pressure" wherein a carburizing, quenching, and tempering treatment, or a carbonitriding, quenching, and tempering treatment are carried out by controlling such that a heating temperature is 930 to 1050° C., a carbon concentration of carburized surface layer is 0.60 to 0.80%, and a quenching temperature is 850 to 900° C.; or after the above described tempering treatment is carried out, at least any one of surface hardening treatments including grinding, shot peening, hard shot peening, and fine particle shot peening is performed.

Patent Document 4 discloses a "carburized component superior in low cycle fatigue characteristic" wherein the component contains, by mass %, C: 0.10 to less than 0.30%, Si: not more than 0.10%, Mn: 0.20 to 0.60%, P: not more than 0.015%, S: not more than 0.035%, Cr: 0.50 to 1.00%, Mo: 0.50 to 1.00%, B: 0.0005 to 0.0030%, Ti: 0.010 to 0.100%, Nb: 0.010 to 0.100%, with the balance made up of Fe with unavoidable impurities, and wherein a surface layer C concentration after a gas carburizing treatment is 0.40 to 0.60%, an effective hardened layer depth, with a critical hardness being 513 in Vickers hardness, is 0.6 to 1.2 mm, and a surface hardness after a shot peening treatment is not less than 700 in Vickers hardness.

Patent Document 5 discloses a "production method of case-hardened product having high-fatigue strength" comprising: processing a steel material into a desired product shape, the steel material containing, by mass ratio, C: 0.15 to 0.35%, Al: 0.01 to 0.15%, N: 0.005 to 0.025%, Mn: 0.30 to 1.2%, Cr: 0.30 to 1.20%, and S: 0.01 to 0.20% and, as desired, further containing one element or two elements in combination out of two groups: (a) Nb: 0.020 to 0.120% and Ti: 0.005 to 0.10%, and (b) Mo: not more than 1.0%, Ni: not more than 4.0%, Cu: not more than 2.0%, and V: not more than 1.0%, with limitations of P: not more than 0.01% and Si: not more than 0.50%, and the balance being Fe and unavoidable impurities; subjecting the product to carburizing and quenching with a carbon potential at which a carbon potential Cp is in a range of 0.4 to 0.9 by mass %, and the difference between the carbon potential and the carbon concentration of the material is not less than 0.2 mass %; and thereafter subjecting one part or whole part of the product to an induction hardening by which a depth of 0.3 to 1.5 times the whole hardened layer at the time of carburizing is austenitized.

CITATION LIST

Patent Document

Patent Document 1: JP5-140726A
Patent Document 2: JP5-156421A
Patent Document 3: JP2007-246941A
Patent Document 4: JP2008-255470A
Patent Document 5: JP64-36779A

Non Patent Document

Non Patent Document 1 Matsushima, et. al., R&D KOBE STEEL ENGINEERING REPORTS, Vol. 50, No. 1 (April 2000), PP. 57 to 60.

SUMMARY OF INVENTION

Technical Problem

The technique proposed in the above described Patent Document 1 assumes a carburizing quenching or carbonitriding quenching as the surface hardening treatment, and utilizes the phenomenon that allowing a soft slack quenched layer to be present in a specific location of the surface layer will cause a soft layer of the surface layer to undergo plastic deformation relatively easily than the hard layer of the inside during shot peening treatment, thus resulting in higher residual compressive stress in the surface layer. Therefore, this technique can improve the fatigue strength in so-called "high cycle region" which concerns a fatigue fracture at a number of repetitions of not less than about $1\times10^6$ cycles such as, for example, in an Ono-type rotary bending fatigue test. However, in the so-called "low to medium cycle region" where impulsive and relatively large loading is applied, even if a large compressive residual stress can be provided to the surface layer, when a slack quenched layer is present, the "slack quenched layer" itself facilitates the initiation of a fatigue crack, and there may a case where the occurrence of fatigue fracture cannot be avoided. Therefore, it is not necessarily possible to achieve an advantageous effect of improving the fatigue strength in the "low to medium cycle region".

The technique proposed in Patent Document 2 aims to limit the total content of Mn, Ni, Cr, and Mo, and the surface C content and the surface N content to be in a specific range, thereby making the amount of retained austenite, which is produced at the time of carburizing and quenching, appropriate so that the advantageous effect of providing surface compressive residual stress by shot peening reaches deeper inside the material. Therefore, this technique also can improve the fatigue strength in a "high cycle region". However, since the deformation by strain induced transformation of retained austenite increase during shot peening treatment when the amount of retained austenite exceeds 20%, it is unavoidable that distortion occurs in the product. Therefore, working for correcting the distortion will become necessary.

The component proposed in Patent Document 3 adjusts the contents of Cr and Mo, which are relatively expensive components in steel material, such that the value of [Cr+2Mo] is 2.00 to 8.00% in ranges of 1.50 to 6.00% of Cr and 0.01 to 3.00% of Mo. For this reason, there may be a case where an increase of the manufacturing cost associated with the increase of the alloying element contents is unavoidable. In the technique proposed in Patent Document 3, carburizing and quenching is performed with C concentration in the carburized surface layer, that is, carbon potential being 0.60 to 0.80%, followed by various shot peening treatment as desired so as to be able to improve the fatigue strength in a high cycle region. However, because of a high carbon potential, it is difficult to avoid "embrittlement" in the surface hardened layer portion. For this reason, it is not necessarily possible to achieve an advantageous effect of improving the fatigue strength in the "low to medium cycle region".

In the technique proposed in Patent Document 4, a shot peening treatment is performed for the purpose of; making up for a decline in surface hardness associated with the lowering of the surface C concentration of a carburized component by providing a compressive residual stress; and suppressing the initiation of a crack due to bending fatigue by regulating the compressive residual stress to have maximum magnitude at a depth of not more than 100 μm from the surface layer; and removing a boundary oxidation layer in the surface layer, which can be a starting point of a crack. Patent Document 4 also discloses that shot peening treatment is performed in two stages. However, since the surface roughness of the component is not taken into consideration at all, when the surface roughness is high, it is expected that a fatigue crack will be readily initiated due to a "notch effect". For this reason, it is not necessarily possible to achieve an advantageous effect of improving fatigue strength in the "low to medium cycle region".

The technique proposed in Patent Document 5 performs carburizing and quenching at a specific carbon potential, and successively performs induction hardening at a specific condition thereby allowing the prior-austenite grain size in the surface layer to be a fine grain of No. 10 or higher in the JIS grain size number, and enabling to provide surface layer compressive residual stress of not more than −294 MPa (−30 kgf/mm$^2$). For this reason, it is possible to achieve a fatigue strength of not less than 941 MPa (96 kgf/mm$^2$) in the fatigue limit evaluated by the Ono-type rotary bending fatigue test using a smooth specimen. However, this method will increase manufacturing cost because both "carburizing and quenching" and "induction hardening" are performed as the surface hardening treatment. Further, there is no disclosure about the fatigue strength in the low to medium cycle region.

The present invention has been achieved in view of the above described situations, and has its object to provide a carburized component significantly improved in fatigue strength in the "low to medium cycle region" and a manufacturing method thereof.

Solution to Problem

The present inventors precisely investigated the microstructure of the hardened layer portion of a component which has been subjected to a hardening treatment, to improve a fatigue property in the "low to medium cycle region".

As a result, the inventors have found that it is necessary to achieve "toughness enhancement" in at least the hardened layer portion in order to improve the fatigue strength in the "low to medium cycle region".

Accordingly, a study has been conducted to achieve toughness enhancement in the hardened layer portion, and it is discovered that suppressing brittle fracture of the hardened layer portion and suppressing a slack quenched structure are crucial.

Suppressing the brittle fracture of the above described hardened layer portion is inferred be achieved by optimizing the C content in the hardened layer portion of the martensite structure. In relation to this, G. Krauss reports in "Materials Science and Engineering, A273-275 (1999)" pp. 40 to 57 that if the C content in the martensite structure when a thermal refining treatment is performed is not more than 0.50%, brittle fracture is suppressed and ductile fracture occurs.

However, when a surface hardening treatment such as "carburizing and quenching" is performed, a distribution of carbon concentration occurs from the component's surface to the inside thereof. Since this distribution of carbon concentration changes depending on carburizing and quenching conditions, the carbon concentration of the inside may become higher than the carbon concentration of the surface. Therefore, it is considered that the characteristic of the hardened layer portion cannot be evaluated solely by the carbon concentration of the utmost surface of the component.

Then, the present inventors melted steel A having a chemical composition shown in Table 1 to fabricate an ingot of 150 kg, and investigated the correlation between the carbon concentration distribution of a carburized product and the fracture mode thereof in fatigue test by a four point bending fatigue test.

The above described steel A is steel corresponding to SCr420 according to the JIS G 4053 (2008).

TABLE 1

| | Chemical composition of the sample material (in mass %, balance: Fe and impurities) | | | | | | | | |
|---|---|---|---|---|---|---|---|---|---|
| Steel | C | Si | Mn | P | S | Cr | Al | N | O |
| A | 0.21 | 0.22 | 0.84 | 0.014 | 0.016 | 1.14 | 0.032 | 0.018 | 0.0008 |

The specific investigation of the correlation between the carbon concentration distribution of a carburized product using the steel A and the fracture mode in a four point bending fatigue test was carried out as described below.

That is, the above described ingot was heated to 1250° C. and thereafter was hot forged into a round bar with a diameter of 30 mm. The cooling after the hot forging was performed by allowing it to cool in the atmosphere.

Next, the round bar with a diameter of 30 mm which was obtained by hot forging was subjected to normalizing treatment in which the round bar was held and soaked at a heating temperature of 900° C. for 60 min, and thereafter allowed to cool in the atmosphere.

A rectangular parallelepiped with a cross section of 13 mm×13 mm, and a length of 100 mm was cut out by machining from the central portion of the normalized round bar with a diameter of 30 mm, and thereafter a semicircular notch with a radius of 2 mm was further provided at a middle location in the longitudinal direction of one surface of the rectangular parallelepiped to fabricate a four-point bending specimen.

Next, as the "carburizing and quenching", the four-point bending specimen was subjected to a carburizing treatment by varying the treatment temperature, holding time, and carbon potential, and thereafter was put into oil of 120° C. After the above described carburizing and quenching was performed, a tempering treatment is carried out in which the specimen was further held and soaked at a heating temperature of 180° C. for 120 min, and thereafter was allowed to cool in the atmosphere.

Using the four-point bending test specimen which had undergone the above described "carburizing and quenching-tempering" treatment, a four-point bending fatigue test was conducted at conditions of a stress ratio of 0.1, an interfulcrum distance of 45 mm, and a test frequency of 5 Hz to investigate fracture modes in 5×10$^3$ cycles strength.

Further, the carbon concentration distribution was investigated in the following manner by using a four-point bending specimen which had undergone carburizing and quenching-tempering treatment at the same conditions as those of the above described investigation of fracture mode. The four-point bending specimen was embedded in resin and ground such that the cross section at the location where the semicircular notch was provided was able to be investigated. Thereafter, with the notched bottom being the outermost surface, the carbon concentration distribution in the direction toward the center of the specimen was measured with a calibration line by using a wavelength dispersive EPMA apparatus.

As a result of the investigation on the correlation between the carbon concentration distribution of the carburized product and the fracture mode in the four-point bending fatigue test by using steel A, the finding of <1> described below was obtained.

<1> The average carbon concentration by mass % in the region from the outermost surface to a point of 0.2 mm depth (hereafter, also referred to as "C(ave)") shows a good correlation with the fracture mode in the four-point bending fatigue test, and brittle fracture can be suppressed when C(ave) is not more than 0.45%.

The above described average carbon concentration in the region from the outermost surface to a point of 0.2 mm depth is calculated by the following equation, where x mm is the distance from the outermost surface toward the center and C(x) % is the carbon concentration in mass % at that location:

$$C(ave)=\{\int C(x)dx\}/0.2=5\times\int C(x)dx$$

In the equation, the integration interval, that is, the range of "x" is 0 to 0.2 (mm).

Based on the finding of <1>, the present inventors decided to use the average carbon concentration in the region from the outermost surface to a point of 0.2 mm depth as one of parameters to represent the toughness enhancement in the hardened layer portion, and conducted the test described below.

That is, steels A to E having chemical compositions shown in Table 2 were melted in a vacuum furnace to fabricate ingots of 150 kg. The steel A in Table 2 is the re-posting of the steel A in Table 1.

TABLE 2

| | Chemical composition of the sample material (in mass %, balance: Fe and impurities) | | | | | | | | | |
|---|---|---|---|---|---|---|---|---|---|---|
| Steel | C | Si | Mn | P | S | Cr | Mo | Al | N | 0 |
| A | 0.21 | 0.22 | 0.84 | 0.014 | 0.016 | 1.14 | — | 0.032 | 0.018 | 0.0008 |
| B | 0.10 | 0.21 | 0.81 | 0.010 | 0.010 | 1.10 | — | 0.031 | 0.014 | 0.0010 |
| C | 0.15 | 0.18 | 0.86 | 0.009 | 0.014 | 1.20 | 0.15 | 0.038 | 0.012 | 0.0007 |
| D | 0.20 | 0.10 | 0.65 | 0.010 | 0.011 | 1.50 | — | 0.040 | 0.008 | 0.0006 |
| E | 0.24 | 0.20 | 1.20 | 0.011 | 0.013 | 0.10 | 0.30 | 0.040 | 0.003 | 0.0007 |

The each steel ingot described above was heated to 1250° C. and thereafter was hot forged into a round bar with a diameter of 30 mm. The cooling of the round bar after the hot forging was conducted by allowing it to cool in the atmosphere.

Next, the round bar with a diameter of 30 mm which was obtained by hot forging was subjected to a normalizing treatment in which the round bar was held and soaked at a heating temperature of 900° C. for 60 min, and thereafter allowed to cool in the atmosphere.

A rectangular parallelepiped with a cross section of 13 mm×13 mm and a length of 100 mm was cut out by machining from the central portion of the normalized round bar with a diameter of 30 mm. Thereafter, a semicircular notch of a radius of 2 mm was provided at a middle location in the longitudinal direction of one surface of the above described rectangular parallelepiped to fabricate a four-point bending specimen.

Next, for each steel described above, the four-point bending specimen was subjected to a carburizing treatment with the soaking temperature being 930° C., and thereafter was put into oil of 120° C. to perform "carburizing and quenching". After the carburizing and quenching was performed, tempering treatment is carried out in which the specimen was held and soaked at a heating temperature of 180° C. for 120 min, and thereafter was allowed to cool in the atmosphere.

For steel A, a "carburizing and quenching-tempering" treatment at a typical condition was also performed on the four-point bending specimen. To be specific, as the "carburizing and quenching", the above described four-point bending specimen was subjected to a carburizing treatment by being soaked at 930° C. for 100 min with a carbon potential of 1.1%, and next for 50 min with a carbon potential of 0.8%, and then temporarily cooled to 870° C. with the carbon potential being kept at 0.8% and further held at that temperature for 60 min, and thereafter was put into oil of 120° C. After the carburizing and quenching was performed, tempering treatment was carried out in which the specimen was held and soaked at a heating temperature of 180° C. for 120 min, and thereafter was allowed to cool in the atmosphere.

Table 3 shows details of the carburizing conditions. "Cp1" and "Cp2" in Table 3 represent "carbon potentials" in carburizing treatment, and first carburizing was performed at the condition of Cp1 for the time shown in "soaking time 1", and then carburizing was performed at the condition of Cp2 for the time shown in "soaking time 2". Test number 17 corresponds to the "carburizing and quenching-tempering" treatment at the above described typical condition. In this carburizing condition of test number 17, description of the above described treatment to "temporarily cool the specimen to 870° C. and further hold it at that temperature for 60 min while keeping the carbon potential at 0.8%" is omitted in Table 3.

TABLE 3

| | | Carburizing Conditions | | | | | HV hardness | | | Shot peening |
|---|---|---|---|---|---|---|---|---|---|---|
| | | Soaking | | Soaking | | Soaking | | | | |
| Test No. | Steel | Temp. (° C.) | Cp1 (%) | Time 1 (min) | Cp2 (%) | Time 2 (min) | surface hardness | core hardness | C(ave) (%) | Treatment Condition |
| 1 | A | 930 | 0.7 | 130 | 0.4 | 80 | 560 | 400 | 0.38 | SP condition I |
| 2 | A | 930 | 0.7 | 100 | 0.6 | 70 | 705 | 402 | 0.58 | SP condition I |
| 3 | A | 930 | 0.7 | 80 | 0.45 | 60 | 640 | 395 | 0.48 | SP condition I |
| 4 | A | 930 | 0.7 | 140 | 0.35 | 90 | 520 | 400 | 0.36 | SP condition I |
| 5 | C | 930 | 0.7 | 130 | 0.4 | 90 | 602 | 360 | 0.41 | SP condition I |
| 6 | D | 930 | 0.7 | 100 | 0.6 | 80 | 710 | 395 | 0.58 | SP condition I |
| 7 | D | 930 | 0.7 | 130 | 0.4 | 80 | 610 | 400 | 0.41 | SP condition I |
| 8 | E | 930 | 0.7 | 100 | 0.6 | 80 | 695 | 445 | 0.59 | SP condition I |
| 9 | B | 930 | 0.7 | 130 | 0.4 | 80 | 550 | 280 | 0.38 | SP condition I |
| 10 | A | 930 | 0.7 | 100 | 0.4 | 70 | 560 | 400 | 0.38 | — |
| 11 | A | 930 | 0.7 | 130 | 0.7 | 80 | 735 | 400 | 0.71 | SP condition I |
| 12 | A | 930 | 0.7 | 140 | 0.3 | 100 | 445 | 400 | 0.32 | SP condition I |
| 13 | A | 930 | 0.9 | 100 | 0.8 | 50 | 760 | 395 | 0.78 | SP condition I |
| 14 | A | 930 | 0.7 | 120 | 0.4 | 90 | 558 | 395 | 0,37 | SP condition II |
| 15 | A | 930 | 0.7 | 80 | 0.6 | 60 | 710 | 400 | 0.56 | SP condition II |
| 16 | C | 930 | 0.7 | 120 | 0.4 | 90 | 560 | 360 | 0.40 | SP condition II |
| 17 | A | 930 | 1.1 | 100 | 0.8 | 50 | 765 | 395 | 0.80 | — |

"—" in the column of shot peening treatment condition indicates that shot peening treatment, is not carried out.

The four-point bending specimen which has undergone the above described "carburizing and quenching-tempering" treatment was used to investigate the hardness and the carbon concentration distribution.

As for hardness, a Vickers hardness (hereafter, also referred to as "HV hardness") was measured after the four-point bending specimen was embedded in resin and ground such that the cross section at the location where the semicircular notch is provided can be investigated. The HV hardness test was conducted by the method defined in JIS Z 2244 (2009) with the test force being 2.94 N, and the hardness of the central portion (hereafter, referred to as "core hardness") and the hardness of a surface portion (hereafter, referred to as "surface hardness") were determined.

The core hardness was represented by an average value of measurements of 5 points at a depth of 10 mm from a reference surface which was the surface where a semicircular notch was provided and which made up one side of the cross section of the specimen embedded in the resin. The surface hardness was represented by an average value of measurements of 5 points at a depth of 0.05 mm from a reference surface which is the surface where the above described semicircular notch was provided.

The carbon concentration distribution was determined as follows. First, as well as in the above described hardness measurement, the four-point bending specimen was embedded in resin and ground such that the cross section at the location where the semicircular notch was provided could be investigated. Thereafter, with the notched bottom being the outermost surface, the carbon concentration distribution in the direction toward the center of the specimen was measured with a calibration line by using a wavelength dispersive EPMA apparatus. Next, using the above described measurement result, C(ave) which was an average carbon concentration in the region from the outermost surface to a point of 0.2 mm depth in the direction toward the center was determined according to the above described equation: $[5\times\int C(x)dx]$.

The surface hardness, the core hardness, and C(ave), which were determined as described above, are shown in Table 3.

For the purpose of providing compressive residual stress, a shot peening treatment by [SP condition I] described below was carried out on the surface provided with the semicircular notch of each four-point bending specimen which had undergone the "carburizing and quenching-tempering" treatments of test numbers 1 to 9 and test numbers 11 to 13 shown in Table 3. A shot peening treatment by [SP condition II] described below was carried out on the surface provided with the semicircular notch of each four-point bending specimen which had undergone the "carburizing and quenching-tempering" treatments of test numbers 14 to 16 shown in Table 3.

Each shot peening treatment was conducted in two stages at the conditions of [SP condition I] and [SP condition II] described below.

[SP Condition I]:

Shot peening treatment condition of the first stage:

Peening media: HV hardness: 700, Average particle diameter: 0.6 mm,

Peening time: 12 s,

Peening air pressure: 0.35 MPa,

Coverage: 500%,

Shot peening treatment condition of the second stage:

Peening media: HV hardness: 800, Average particle diameter: 0.1 mm,

Peening time: 20 s,

Peening air pressure: 0.2 MPa,

Coverage: 500%.

[SP Condition II]

Shot peening treatment condition of the first stage:

Peening media: HV hardness: 780, Average particle diameter: 1.2 mm,

Peening time: 10 s,

Peening air pressure: 0.35 MPa,

Coverage: 500%

Shot peening treatment condition of the second stage:

Peening media: HV hardness: 800, Average particle diameter: 0.1 mm,

Peening time: 8 s,

Peening air pressure: 0.2 MPa,

Coverage: 200%.

Next, using four-point bending specimens which had further undergone shot peening treatment of each condition after the "carburizing and quenching-tempering" treatments of test numbers 1 to 9 and test numbers 11 to 16 shown in Table 3, and four-point bending specimens which were as treated with the "carburizing and quenching-tempering" treatment of test numbers 10 and 17 shown in Table 3 and had not undergone any shot peening treatment, a four-point bending fatigue test was conducted at the following conditions:

Stress ratio: 0.1,

Inter-fulcrum distance: 45 mm, and

Test frequency: 5 Hz.

In the above described four-point bending fatigue test, a crack initiation strength at a number of cycles of $5\times10^3$ were evaluated as the "bending fatigue strength".

The improvement target of the bending fatigue strength was set to 50% or more improvement with reference to the bending fatigue strength of test number 17 which is a representative example of surface hardening treatment components (that is, the bending fatigue strength of test number 17 which uses steel A corresponding to SCr420 which is common as the case hardening steel, and was subjected to the bending fatigue test as treated with the "carburizing and quenching-tempering" treatment at a typical condition).

Table 4 shows results of the bending fatigue test. Also shown in Table 4 are improvement rates of bending fatigue strength with reference to the bending fatigue strength of test number 17.

TABLE 4

| | | Bending Fatigue Properties | |
|---|---|---|---|
| Test No. | Steel | Bending Fatigue Strength (MPa) | Improvement Rates of Bending Fatigue Strength (%) |
| 1 | A | 1305 | 73 |
| 2 | A | 1155 | 53 |
| 3 | A | 1250 | 66 |
| 4 | A | 1135 | 51 |
| 5 | C | 1350 | 79 |
| 6 | D | 1140 | 51 |
| 7 | D | 1405 | 87 |
| 8 | E | 1150 | 53 |
| 9 | B | 905 | 20 |
| 10 | A | 1038 | 38 |
| 11 | A | 995 | 32 |
| 12 | A | 1079 | 43 |
| 13 | A | 920 | 22 |
| 14 | A | 1069 | 42 |
| 15 | A | 1095 | 45 |
| 16 | C | 1020 | 35 |
| 17 | A | 753 | — |

"Improvement rates of bending fatigue strength" is based on the bending fatigue strength of test number 17.

FIG. 1 demonstrates improvement rates of bending fatigue strength with reference to that of test number 17 as a function of C(ave) which is an average carbon concentration by mass % in the region from the outermost surface to a point of 0.2 mm depth.

On the basis of FIG. 1, the present inventors have reached the following conclusion of <2>.

<2> If the average carbon concentration in the region from the outermost surface to a point of 0.2 mm depth is within a range of 0.35 to 0.60% by mass %, it is possible to improve the bending fatigue strength by 50% or more with reference to the bending fatigue strength of an ordinary carburized product by providing compressive residual stress on the component's surface by, for example, carrying out a shot peening treatment. In particular, even when the average carbon concentration of the hardened layer portion is 0.45 to 0.60%, that is, in a case where the fracture surface mode of the hardened layer portion will change to "brittle", providing compressive residual stress on the surface of the component by a shot peening treatment or the like makes it possible to suppress brittle fracture and improve fatigue strength.

However, it is considered that although compressive residual stress can be provided by shot peening treatment, there is a distribution in the residual stress as in the carbon concentration, and this residual stress distribution varies depending on the treatment conditions of shot peening.

In general, it is said that there is a correlation between the fatigue strength in the "high cycle region" and a minimum value (a maximum value when represented by absolute values) of the compressive residual stress introduced by the shot peening treatment. However, it is not known if the same correlation is established between the fatigue strength in the "low to medium cycle region" and the minimum value of the compressive residual stress.

Further, in a normal case, shot peening treatment is performed on a component whose hardened layer portion will have a hardness of not less than 720 in HV hardness as represented by a carburized product whose carbon potential is set to about 0.8%. For this reason, it is considered that the change in surface roughness associated with shot peening treatment will not cause a significant problem.

However, the value of C(ave) of 0.35 to 0.60% by mass % that is described in <2> is lower compared with the average carbon concentration in the case of the above described carburizing treatment with carbon potential being set at about 0.8%. Thus, the hardness of the hardened layer portion in the case where C(ave) is 0.35 to 0.60% is lower compared with the hardness of the hardened layer portion of a normal carburized product that has undergone a carburizing treatment with a carbon potential of about 0.8%, and thereby it is considered that the change of the surface roughness also increases when shot peening is performed to provide compressive residual stress.

Moreover, in the case of fatigue in the "low to medium cycle" region, a relatively large loading stress acts impulsively. Therefore, when the surface roughness is rough, it is supposed that surface roughness has a "notch effect" thereby causing a decline of fatigue strength.

Accordingly, the present inventors studied and investigated the correlation between the fatigue strength in the "low to medium cycle region", and the compressive residual stress and surface roughness.

That is, first, using four-point bending specimens treated at the same condition with that of the four-point bending specimens whose bending fatigue properties are shown in Table 4 (to be specific, four-point bending specimens of test numbers 1 to 9 and test numbers of 11 to 16, which were subjected to the "carburizing and quenching-tempering" treatment and the shot peening treatment at the same condition with that of the four-point bending specimens which were subjected to the above described bending fatigue test, and the four-point bending specimens of test number 10 and test number 17, which were subjected to only the "carburizing and quenching-tempering" treatment), the compressive residual stress that was introduced in the surface of the bottom provided with a semi-circular notch, that is, the value of compressive residual stress at the outermost surface (hereafter, referred to as "$\sigma r(\mathbf{0})$"), and the value of compressive residual stress at a point of 100 μm from the outermost surface (hereafter, referred to as "$\sigma r(\mathbf{100})$") were investigated.

The specimen was ground from the surface to the point of a predetermined depth by electrolytic grinding, and the intensity of diffracted X-ray was measured at each depth point so that the compressive residual stress was determined from the relationship between the half-value width of a peak intensity obtained by the measurement and the central position of the peak.

Table 5 shows the results of the above described investigation of residual stress. Also shown in Table 5 is a residual stress intensity index Ir, which is calculated by the following equation, where y μm is the depth from the outermost surface (hereafter, also simply referred to as "depth"), and σr(y) is the residual stress for the points from the outermost surface to a depth of 100 μm:

$$Ir=\int|\sigma r(y)|dy$$

"|σr(y)|" in the above described equation refers to the absolute value of the compressive residual stress at the location where the depth from the outermost surface is y μm. Further, the integration interval, that is, the range of "y" is 0 to 100 (μm).

The residual stress intensity index Ir can be determined by, for example, a method shown in the following (1) to (8).

(1) The outermost surface of the target specimen to be 0 μm as the reference point.

(2) Grind the specimen to a point of y(1) μm depth by electrolytic grinding.

(3) Measure compressive residual stress at the location of y(1) μm depth by using X-ray. Usual methods can be employed for measuring the compressive residual stress by using X-ray.

(4) Next, grind the specimen to a point of depth y(2) μm by electrolytic grinding again.

(5) Measure compressive residual stress at the location of y(2) μm depth in the same manner as in the above described (3).

(6) Repeat the above described electrolytic grinding as far as to a point of 100 μm depth, and measure compressive residual stress at the location of each depth that is electrolytically ground.

(7) Plot the relationship between the obtained depth and the compressive residual stress for the points from 1 to 100 μm depth taking the depth in the abscissa and the absolute value of compressive residual stress in the ordinate, and determine the relation between the depth and the absolute value of compressive residual stress as a function (in other words, approximate it with a curve).

(8) Calculate the area of the portion of the curve, which is obtained at (7) described above, interposed between the ordinate and the abscissa, so that the residual stress intensity index Ir which is the integral of the absolute value of the compressive residual stress can be determined.

The values of Ir shown in Table 5 are those determined by measuring compressive residual stress at each point of 0 μm, 10 μm, 30 μm, 50 μm, 80 μm, and 100 μm depths by the method shown in (1) to (8) described above.

Also shown in table 5 are the "improvement rates of bending fatigue strength" in Table 4.

TABLE 5

| Test No. | Steel | Residual Stress σr(0) (MPa) | Residual Stress σr(100) (MPa) | Residual Stress Intensity Index Ir (MPa · μm) | Improvement Rates of Bending Fatigue Strength (%) |
|---|---|---|---|---|---|
| 1 | A | −950 | −1000 | 98000 | 73 |
| 2 | A | −1095 | −1186 | 110500 | 53 |
| 3 | A | −1063 | −1075 | 108000 | 66 |
| 4 | A | −900 | −920 | 91500 | 51 |
| 5 | C | −1060 | −1000 | 103000 | 79 |

TABLE 5-continued

| Test No. | Steel | Residual Stress σr(0) (MPa) | Residual Stress σr(100) (MPa) | Residual Stress Intensity Index Ir (MPa · μm) | Improvement Rates of Bending Fatigue Strength (%) |
|---|---|---|---|---|---|
| 6 | D | −1072 | −1075 | 107400 | 51 |
| 7 | D | −1050 | −1000 | 103000 | 87 |
| 8 | E | −1100 | −1160 | 115000 | 53 |
| 9 | B | −850 | −900 | 86500 | 20 |
| 10 | A | −120 | 0 | 7000 | 38 |
| 11 | A | −1020 | −1100 | 108000 | 32 |
| 12 | A | −820 | −860 | 84000 | 43 |
| 13 | A | −1100 | −1150 | 113000 | 22 |
| 14 | A | −940 | −980 | 96000 | 42 |
| 15 | A | −1050 | −1150 | 109000 | 45 |
| 16 | C | −1040 | −1020 | 103000 | 35 |
| 17 | A | −100 | 0 | 6000 | — |

"Improvement rates of bending fatigue strength" is based on the bending fatigue strength of test number 17.

From Table 5, the fact of <3> described below has been newly revealed.

<3> The improvement rate of bending fatigue strength is significantly affected by σr(0), σr(100), and the distribution state of residual stress. Thus, the target that the improvement rate of bending fatigue strength is not less than 50% can be achieved when both of σr(0) and σr(100) satisfy the condition of not more than −800 MPa, and the residual stress intensity index Ir is not less than 80000.

The reason why the σr(0), σr(100), and the residual stress intensity index Ir affect the improvement rate of bending fatigue strength is considered that these parameters affect the initiation of fatigue crack.

However, as evidenced by Table 5, even if the condition of <3> described above is satisfied, there is a case where the improvement rate of bending fatigue strength is low as with test numbers 14 to 16, and has not reached the target, which is not less than 50%.

High surface roughness of the specimens is thought to be a cause of the decline of the improvement rate of bending fatigue strength. That is, it is considered that the surface roughness of specimen affects the initiation of a fatigue crack, and when the surface roughness of the component is high, a fatigue crack will be readily initiated due to a "notch effect", and thereby reducing fatigue strength.

Then, next, as in the case of the measurement of compressive residual stress, using four-point bending specimens which were treated at the same condition with that of the four-point bending specimens whose bending fatigue properties are shown in Table 4 (specifically, four-point bending specimens of test numbers 1 to 9 and test numbers of 11 to 16, which were subjected to the "carburizing and quenching-tempering" treatment and the shot peening treatment at the same conditions, and the four-point bending specimens of test number 10 and test number 17, which were subjected to only the "carburizing and quenching-tempering" treatment), surface roughness (specifically, the surface roughness in maximum height Rz defined in JIS B 0601 (2001)) was measured.

Table 6 shows results of the above described Rz measurement. Table 6 also shows the "improvement rate of bending fatigue strength" of Table 4 described above, "σr(0)", "σr(100)", and "residual stress intensity index Ir" of Table 5.

TABLE 6

| Test No. | Steel | Surface Roughness Rz (μm) | Residual Stress σr (0) (MPa) | Residual Stress σr (100) (MPa) | Residual Stress Intensity Index Ir (MPa · μm) | Improvement Rates of Bending Fatigue Strength (%) |
|---|---|---|---|---|---|---|
| 1 | A | 12.20 | −950 | −1000 | 98000 | 73 |
| 2 | A | 7.05 | −1095 | −1186 | 110500 | 53 |
| 3 | A | 10.26 | −1063 | −1075 | 108000 | 66 |
| 4 | A | 11.20 | −900 | −920 | 91500 | 51 |
| 5 | C | 10.50 | −1060 | −1000 | 103000 | 79 |
| 6 | D | 7.20 | −1072 | −1075 | 107400 | 51 |
| 7 | D | 11.90 | −1050 | −1000 | 103000 | 87 |
| 8 | E | 6.90 | −1100 | −1160 | 115000 | 53 |
| 9 | B | 12.20 | −850 | −900 | 86500 | 20 |
| 10 | A | 3.40 | −120 | 0 | 7000 | 38 |
| 11 | A | 6.50 | −1020 | −1100 | 108000 | 32 |
| 12 | A | 14.50 | −820 | −860 | 84000 | 43 |
| 13 | A | 6.40 | −1100 | −1150 | 113000 | 22 |
| 14 | A | 16.00 | −940 | −980 | 96000 | 42 |
| 15 | A | 15.50 | −1050 | −1150 | 10900 | 45 |
| 16 | C | 17.50 | −1040 | −1020 | 10300 | 35 |
| 17 | A | 3.40 | −100 | 0 | 6000 | — |

"Improvement rates of bending fatigue strength" is based on the bending fatigue strength of test number 17.

From Table 6, the fact of <4> described below has been newly revealed.

<4> The improvement rate of bending fatigue strength in the "low to medium cycle region" is significantly affected by the surface roughness in maximum height Rz defined in JIS B 0601 (2001). Thus, the target that the improvement rate of bending fatigue strength is not less than 50% can be achieved when Rz is not more than 15 μm. Therefore, when providing compressive residual stress by a shot peening treatment, the shot peening treatment needs to be performed at such a condition as to be able to eventually satisfy [Rz≤15 μm].

The present invention has been completed based on the above described findings, and involves a carburized component shown in the following (1) to (3), and a manufacturing method for the carburized component shown in (4).

(1) A carburized component made of steel, wherein base steel is a steel having a chemical composition containing, by mass %, C: 0.15 to 0.25%, Si: 0.03 to 0.50%, Mn: more than 0.60% and not more than 1.5%, P: not more than 0.015%, S: 0.006 to 0.030%, Cr: 0.05 to 2.0%, Al: not more than 0.10%, N: not more than 0.03%, and 0: not more than 0.0020%, the balance being Fe and impurities, wherein a surface hardened layer portion satisfies following conditions of (a) to (c):

(a) C(ave): by mass %, 0.35 to 0.60%, (b) surface roughness Rz: not more than 15 μm, and (c) σr(0): not more than −800 MPa, σr(100): not more than −800 MPa, and residual stress intensity index Ir: not less than 80000.

"C(ave)" is an average carbon concentration in the region from the outermost surface to a point of 0.2 mm depth and calculated by [$C(ave)=5\times\int C(x)dx$], where x is the distance in mm from the outermost surface toward the center and C(x) % is the carbon concentration by mass % at the location of x. Where, the integral interval, that is, the range of "x" is 0 to 0.2 (mm).

The surface roughness "Rz" refers to "the surface roughness in maximum height" defined in JIS B 0601 (2001).

"σr(0)" refers to the compressive residual stress at the outermost surface of the component, and "σr(100)" to the compressive residual stress at a point 100 μm from the outermost surface of the component.

The residual stress intensity index "Ir" is calculated by [$Ir=\int|\sigma r(y)|dy$], where y μm is the depth from the outermost surface and σr(y) is the residual stress for the points from the outermost surface to a depth of 100 μm. Here, the integration interval, that is, the range of "y" is 0 to 100 (μm).

(2) The carburized component according to (1), wherein the base steel is a steel having a chemical composition further containing, in lieu of part of Fe, at least one element selected from, by mass %, Mo: less than 0.50%, Cu: not more than 1.0%, Ni: not more than 3.0%, and B: not more than 0.0030%.

(3) The carburized component according to (1) or (2), wherein the base steel is a steel having a chemical composition further containing, in lieu of part of Fe, at least one element selected from, by mass %, Ti: not more than 0.10%, Nb: not more than 0.10%, and V: not more than 0.30%.

(4) A method for manufacturing a carburized component, wherein treatments of steps (a) and (b) described below are successively carried out on a component which is formed into a desired shape by using steel having the chemical composition of the base steel according to any one of (1) to (3).

step (a): Quenching treatment is performed such that the average carbon concentration in the region from the outermost surface to a point of 0.2 mm depth of a component is, by mass %, 0.35 to 0.60%, by performing carburizing treatment in the atmosphere with a carbon potential of 0.35 to 0.90%, or tempering treatment is further performed at a temperature not higher than 200° C. after the quenching treatment.

step (b): A two-stage shot peening treatment which satisfies the conditions described below is carried out.

Shot peening treatment condition of the first stage:

HV hardness of peening media: 650 to 750,

Average particle diameter of peening media: 0.6 to 1.0 mm,

Coverage: not less than 500%,

Shot peening treatment condition of the second stage:

HV hardness of peening media: 700 to 850,

Average particle diameter of peening media: 0.05 to 0.25 mm, and

Coverage: not less than 500%.

"Impurities" in the present description refer to those incorporated from ores and scraps etc. as the raw material, or from the environment when industrially manufacturing steel material.

Advantageous Effects of Invention

The fatigue strength in the "low to medium cycle region" of the carburized component of the present invention is significantly improved compared with that of a component which has undergone a conventional carburizing and quenching-tempering treatment. As a result, the present carburized component is suitable for use as various shafts or power transmission parts of automobiles, construction machines, industrial machines and the like, which may be subjected to impulsive, and relatively large loading.

BRIEF DESCRIPTION OF DRAWINGS

FIG. 1 is a diagram to demonstrate improvement rates of bending fatigue strength with reference to the bending fatigue strength of test number 17 as a function of C(ave) which is average carbon concentration in mass % in the region from the outermost surface to a depth of 0.2 mm.

DESCRIPTION OF EMBODIMENTS

Hereafter, each requirement of the present invention will be described in detail. It is noted that "%" of the content of each element means "mass %".

(A) Chemical Composition of Base Steel

C: 0.15 to 0.25%

C (Carbon) has the effect of ensuring the strength of steel and, the effect of ensuring the hardness of hardened layer after carburizing and quenching. However, when carburizing treatment is a precondition, if the C content is less than 0.15%, strength suitable for use as various shafts or power transmission parts for automobiles, construction machines, industrial machines, and the like cannot be obtained. On one hand, if the C content exceeds 0.25%, the machinability of the component when forming it into a predetermined shape deteriorates. Therefore, the C content is from 0.15 to 0.25%.

Fatigue strength is affected by the core hardness of the component as well. Especially, for using it as various shafts or power transmission parts and the like, the core hardness of the component is preferably not less than 350 in HV hardness. Therefore, the lower limit of the C content is preferably 0.20%. The upper limit of the C content is preferably 0.24%.

Si: 0.03 to 0.50%

Si (Silicon) is a deoxidizing element, and further is an element having a so-called "temper softening resistance" effect to suppress the reduction of hardness when subjecting a martensite structure to tempering treatment. However, if the Si content is less than 0.03%, such advantageous effect is hardly to be achieved. On the other hand, as the Si content increase, A3 transformation point rises so that an abnormal structure during decarburizing and carburizing is more likely to be generated, and especially if the Si content exceeds 0.50%, abnormal decarburizing and carburizing layers will be more remarkably produced. Therefore, the Si content is from 0.03 to 0.50%. The lower limit of the Si content is preferably 0.08%. The upper limit of the Si content is preferably 0.35%.

Mn: more than 0.60% and not more than 1.5%

Mn (Manganese) is an effective element to improve hardenability. Further, Mn has the effect of increasing the amount of retained austenite of the hardened layer portion after carburizing treatment, and especially when the Mn content exceeds 0.60%, retained austenite is formed in the hardened layer portion after carburizing treatment. Therefore, when providing a compressive residual stress by a shot peening treatment, the compressive residual stress can be introduced deeply and stably. However, even if more than 1.5% of Mn is contained, the above described advantageous effect will saturated, and in addition to that, as a result of excessive formation of retained austenite, the surface roughness after shot peening treatment will be high. Besides, the cost will inevitably rise. Therefore, the Mn content is more than 0.60% and not more than 1.5%. When providing compressive residual stress by a shot peening treatment, in order to introduce that compressive residual stress more deeply and more stably, it is particularly preferable that the lower limit of the Mn content is 0.70% and the upper limit thereof is 1.20%.

P: not more than 0.015%

P (phosphorus) deteriorates the toughness of the hardened layer at the time of quenching, and particularly, when the P content exceeds 0.015%, the deterioration of the toughness of hardened layer becomes pronounced. Therefore, the P content is not more than 0.015%. The P content is preferably not more than 0.010%.

S: 0.006 to 0.030%

S (sulfur) combines with Mn to form MnS, and thus has the effect of improving machinability, especially chip treatability. However, if the S content is less than 0.006%, such advantageous effect is hardly to be achieved. On one hand, if the S content increases and thereby the amount of MnS to be formed increases, even though the machinability is improved, the fatigue strength will deteriorate, and particularly, if the S content exceeds 0.030%, the deterioration of fatigue strength becomes pronounced. Therefore, the S content is from 0.006 to 0.030%. The lower limit of the S content is preferably 0.008%. The upper limit of the S content is preferably 0.020%.

Cr: 0.05 to 2.0%

Cr (chromium) has the advantageous effect of improving hardenability of steel. Since Cr combines with C to form composite carbides at the time of surface hardening treatment such as a carburizing treatment, it also has the advantageous effect of improving wear resistance. In order to reliably achieve these advantageous effects, the Cr content is not less than 0.05%. However, if the Cr content exceeds 2.0%, the toughness deteriorates. Therefore, the Cr content is from 0.05 to 2.0%. The lower limit of the Cr content is preferably 0.10%. The upper limit of the Cr content is preferably 1.85%.

Al: not more than 0.10%

Al (aluminum) has the effect of stabilizing and homogenizing the steel deoxidation. However, if the Al content exceeds 0.10%, the above described advantageous effect will be saturated, and besides the toughness of the steel will deteriorate. Therefore, the Al content is not more than 0.10%. The Al content is preferably not more than 0.08%, and more preferably not more than 0.05%.

For the Al content, a lower limit is not necessarily to be set. However, an excessive reduction of the Al content will disable the achievement of sufficient deoxidation effect, thereby deteriorating the cleanliness of steel, and cause an increase of manufacturing cost. Therefore, a preferable lower limit of the Al content is 0.005%. As long as at least 0.005% of Al is contained, the advantageous effects of stabilizing and homogenizing the steel deoxidation are sufficient.

N: not more than 0.03%

N (nitrogen) dissolves into steel, and if the dissolved N content increases, the hot deformability will be deteriorated. Therefore, the N content is not more than 0.03%. The N content is preferably reduced as far as possible.

O: not more than 0.0020%

O (oxygen) is present in steel as an impurity and combines with elements in steel to form oxides, thereby leading to a deterioration of strength, in particular, a deterioration of fatigue strength. Particularly, if the O content exceeds 0.0020%, the amount of oxides to be formed will increase and MnS particles coarsen, leading to a pronounced deterioration of fatigue strength. Therefore, the O content is not more than 0.0020%. The O content is preferably not more than 0.0015%.

One of the base steels of the present carburized components has a chemical composition made up of the above described elements, the balance being Fe and impurities.

One of the base steels of the present carburized components has a chemical composition further containing, in lieu of part of Fe of the above described "Fe and impurities" as the balance, at least one element selected from Mo, Cu, Ni, B, Ti, Nb, and V.

Hereafter, the effects of the optional elements of Mo, Cu, Ni, B, Ti, Nb, and V, and the reason for limiting their contents will be explained.

Mo, Cu, Ni, and B have the effect of improving hardenability. Therefore, when it is desired to ensure a greater hardenability, these elements may be contained. Hereafter, the above described Mo, Cu, Ni, and B will be described, respectively.

Mo: less than 0.50%

Mo (molybdenum) is an effective element to improve hardenability of steel. Mo is also an effective element to enhance the suppression of the formation of grain boundary cementite, which will cause grain boundary embrittlement, and the temper softening resistance, thereby improving the surface fatigue strength. However, even if Mo is contained not less than 0.50%, the above described advantageous effect will be saturated, and it will result in a cost increase. For this reason, when Mo is contained, the content is less than 0.50%. The upper limit of the Mo content is preferably 0.35%.

On the other hand, to stably improve the hardenability of steel and achieve the advantageous effects of suppressing grain boundary cementite and improving the surface fatigue strength, the lower limit of the Mo content is preferably 0.10%.

Cu: no more than 1.0%

Cu (cupper) has the effect of improving hardenability. Therefore, Cu may be contained to achieve such advantageous effect. However, if the Cu content exceeds 1.0%, hot workability will deteriorate. Therefore, when Cu is contained, the content is not more than 1.0%. The Cu content is preferably not more than 0.50%.

On the other hand, to reliably achieve the above described advantageous effect of Cu, the lower limit of the Cu content is preferably 0.05%, and more preferably 0.10%.

Ni: not more than 3.0%

Ni has the effect of improving hardenability. Therefore, to achieve such advantageous effect, Ni may be contained. However, even if the Ni content is more than 3.0%, the above described advantageous effect will be saturated, and it will result in a cost increase. Therefore, when Ni is contained, the content is not more than 3.0%. The Ni content is preferably not more than 2.0%.

On the other hand, to reliably achieve the above described advantageous effect of Ni, the lower limit of the Ni content is preferably 0.05%, and more preferably 0.10%.

B: not more than 0.0030%

B (boron) has the effect of improving hardenability. B also has the effect of suppressing the segregation of P and S at austenite grain boundaries during quenching. Therefore, to achieve such advantageous effect, B may be contained. However, even if the B content is more than 0.0030%, the above described advantageous effect will be saturated, and it will result in a cost increase. Therefore, when B is contained, the content is not more than 0.0030%. The B content is preferably not more than 0.0020%.

On the other hand, to reliably achieve the above described advantageous effect of B, the lower limit of the B content is preferably 0.0005%, and is more preferably 0.0010%.

Even when B is contained in an amount of the above described range, if B combines with N in steel to form BN, the above described advantageous effect will not be expected. Therefore, to allow B to exert its advantageous effect, that is, the advantageous effects of improving hardenability and suppressing the segregation of P and S into austenite grain boundaries, it is necessary to reduce the N content in steel.

At least one element from the above described Mo, Cu, Ni, and B can be contained. The total content of these elements may be less than 4.5030%, but is more preferably not more than 4.0%.

Next, Ti, Nb, and V have the effect of refining grains. For this reason, when it is desired to ensure this advantageous effect, these elements may be contained. Hereafter, the above described Ti, Nb, and V will be described, respectively.

Ti: not more than 0.10%

Ti (titanium) has the effect of refining grains. That is, Ti combines with C or N in steel to form carbides, nitrides, or carbo-nitrides, and thereby has the effect of refining grains at the time of quenching. Therefore, to achieve this advantageous effect, Ti may be contained. However, if the Ti content is more than 0.10%, although the advantageous effects of refining grains and immobilizing N can be obtained, toughness will deteriorate. Therefore, when Ti is contained, the content is not more than 0.10%. The Ti content is preferably not more than 0.08%.

On the other hand, to reliably achieve the above described advantageous effect of Ti, the lower limit of the Ti content is preferably 0.010%, and more preferably 0.015%.

Nb: not more than 0.10%

Nb (niobium) has the effect of refining grains. That is, Nb combines with C or N in steel to form carbides, nitrides, or carbo-nitrides, and thereby has the effect of refining grains. Nb also has the effect of improving the strength of steel. Therefore, to achieve these advantageous effects, Nb may be contained. However, even if the Nb content is more than 0.10%, the above described advantageous effect will be saturated, and it will result in a cost increase and further a deterioration of toughness. Therefore, when Nb is contained, the content is not more than 0.10%. The Nb content is preferably not more than 0.08%.

On the other hand, to reliably achieve the above described advantageous effect of Nb, the lower limit of the Nb content is preferably 0.01%, and is more preferably 0.015%.

V: not more than 0.30%

V (vanadium) has the effect of refining grains. That is, V combines with C or N in steel to form carbides, nitrides, or carbo-nitrides, and thereby has the effect of refining grains. V also has the effect of improving the strength of steel. Therefore, to achieve these advantageous effects, V may be contained. However, even if the V content is more than 0.30%, the above described advantageous effects will be saturated, and it will result in a cost increase and further a deterioration of toughness. Therefore, when V is contained, the content is not more than 0.30%. The V content is preferably not more than 0.25%.

On the other hand, to reliably achieve the above described advantageous effects of V, the lower limit of the V content is preferably 0.005%, and is more preferably 0.010%.

At least one element from the above described Ti, Nb, and V can be contained. The total content of these elements may be not more than 0.50%, but is preferably not more than 0.40%.

(B) Characteristic of Hardened Layer Portion of Surface

In the carburized component of the present invention, in which the base steel has a chemical composition as described in the above described (A), the hardened layer portion of the surface must satisfies the following conditions (a) to (c).

(a) C(ave): 0.35 to 0.60%, (b) Surface roughness Rz: not more than 15 μm, and (c) $\sigma r(\mathbf{0})$: not more than −800 MPa, $\sigma r(\mathbf{100})$: not more than −800 MPa, and residual stress intensity index Ir: not less than 80000.

Hereafter, the above described (a) to (c) will be described, respectively.

(a) C(ave):

The carbon concentration in the hardened layer portion of the surface of a carburized component significantly affects the fatigue strength thereof. If C(ave), which is an average carbon concentration in the region from the outermost surface to a point of 0.2 mm depth, is less than 0.35%, although brittle fracture will not occur the fatigue strength is low; on the other hand, if it exceeds 0.60%, brittle fracture will occur and it will be difficult to improve the fatigue strength even when a compressive residual stress is provided. Therefore, C(ave) is from 0.35% to 0.60%. The lower limit of C(ave) is preferably 0.38%. The upper limit of C(ave) is preferably 0.58%.

(b) Surface roughness Rz;

The surface roughness of a carburized component affects the initiation of fatigue crack. The high surface roughness of the component readily initiates a fatigue crack due to a "notch effect", and thereby deteriorates the fatigue strength. Particularly, if Rz which refers to "the surface roughness in maximum height" defined in JIS B 0601 (2001) exceeds 15 μm in the "low to medium cycle region", the notch effect becomes profound, and the fatigue strength cannot be improved. Therefore, the surface roughness Rz is not more than 15 μm. The upper limit of Rz is preferably 13 μm. If Rz is smaller than 2.0 μm, there is an increasing risk that scoring occurs during sliding movement. Therefore, the lower limit of Rz is preferably 2.0 μm.

(c) Residual stress (σr(0), σr(100), and the residual stress intensity index Ir);

Although fatigue strength can be increased by providing a compressive residual stress on the component's surface, the distribution state of the residual stress from the outermost surface to a point of 100 μm has a significant effect on the fatigue strength.

If either of "σr(0)" which is a compressive residual stress at the outermost surface, and "σr(100)" which is a compressive residual stress at a point 100 μm from the upmost surface is larger than −800 MPa (that is, either the absolute values thereof is smaller than 800 MPa), improvement of fatigue strength cannot be expected. Further, even if "σr(0)≤−800 MPa" and "σr(100)≤−800 MPa" are satisfied, when the residual stress intensity index Ir is smaller than 80000, advantageous effect of improving fatigue strength cannot be expected.

Therefore, all of σr(0): not more than −800 MPa, σr(100): not more than −800 MPa, and the residual stress intensity index Ir: not less than 80000, are to be satisfied.

The upper limit of σr(0) is preferably −850 MPa. The upper limit of σr(100) is preferably −850 MPa. Further, the lower limit of residual stress intensity index Ir is preferably 82000.

On the other hand, the smaller the σr(0) and σr(100), which are compressive residual stresses, (that is, the larger the absolute values thereof), the larger the contribution to the fatigue strength. Therefore, the lower values thereof will not be particularly defined.

The residual stress intensity index Ir, which is calculated by the following equation, where y μm is the depth from the outermost surface and σr(y) is the residual stress for the points from the outermost surface to a depth of 100 μm:

$$Ir=\int|\sigma r(y)|dy$$

is an integrated value of the compressive residual stress that contributes to the improvement of fatigue strength, in which the larger the residual stress intensity index is, the larger the degree by which the fatigue strength is increased. For this reason, the upper limit of the residual stress intensity index Ir will not be particularly defined as well.

(C) Manufacturing Condition:

The manufacturing condition to be described in detail below is one of the methods to achieve the present carburized components in economically effective manner and in an industrial scale, and the technical scope of the carburized component itself will not be defined by the manufacturing conditions.

A carburized component relating to the present invention can be manufactured, for example, by successively carrying out the treatments described in steps (a) and (b) described below on a component which is formed into a desired shape by using steel having the chemical composition of the base steel according to the item (A).

The condition of the manufacturing of a formed component before carrying out the treatment of the step (a) is not particularly specified.

(C-1) "Carburizing and quenching" treatment or "carburizing and quenching-tempering" treatment of the step (a):

In the step (a), quenching treatment is performed after adjusting that the average carbon concentration in the region from the outermost surface to a point of 0.2 mm depth of the component is, by mass %, 0.35 to 0.60% by performing carburizing treatment in the atmosphere with a carbon potential of 0.35 to 0.90%, or tempering treatment is further performed at a temperature not higher than 200° C. after the quenching treatment.

That is, by performing carburizing treatment in an atmosphere with a carbon potential of 0.35 to 0.90% in the step (a) which is a "carburizing and quenching" treatment or a "carburizing and quenching-tempering" treatment, it is possible to easily adjust C(ave), which is an average carbon concentration in the region from the outermost surface to a depth of 0.2 mm as the characteristic of the hardened layer portion of the surface of the item (B), to be 0.35 to 0.60% only by managing, for example, the temperature of carburizing and the soaking time.

The carburizing treatment in the above described atmosphere may be performed, for example, with the temperature being 890 to 950° C. and the soaking time being 120 to 300 min.

The lower limit value of the temperature in the above described tempering treatment is preferably 100° C. By setting the temperature to not lower than 100° C., it is possible to sufficiently prevent a phenomenon (season cracking) that a crack occurs at some time after a low-concentration carburizing and quenching.

(C-2) Shot Peening Treatment of the Step (b):

Shot peening as means for providing compressive residual stress in the surface hardened layer portion of a carburized component may be preferably performed as a two-stage shot peening treatment of the step (b), that is, at the following conditions:

Shot peening treatment condition of the first stage:

HV hardness of peening media: 650 to 750,

Average particle diameter of peening media: 0.6 to 1.0 mm,

Coverage: not less than 500%, and

Shot peening treatment condition of the second stage:

HV hardness of peening media: 750 to 850,

Average particle diameter of peening media: 0.05 to 0.25 mm,

Coverage: not less than 500%.

Since, in the hardened layer portion of the surface of the carburized component of the present invention, C(ave) is 0.35 to 0.60% as described above, the hardness of the surface hardened layer portion is lower compared with conventional carburized components.

If shot peening, which is means of providing a compressive residual stress, is performed on a component whose hardened layer portion has a lower hardness than that of a conventional carburized component using hard peening media (hereafter, also referred to as "shot ball") in the same manner as for a conventional carburized component, that is, a component whose hardened layer portion has a hardness of not less than 720 in HV hardness, although it is possible to provide compressive residual stress, it is difficult to simultaneously satisfy all of the conditions as the characteristics of the hardened layer portion of the surface of the above described item (B): that is, σr(0): not more than −800 MPa, σr(100): not more than −800 MPa, and residual stress intensity index Ir: not less than 80000. Moreover, since the surface roughness Rz of the component may increase and exceed 15 μm, there may be a case where not only the improvement of "low to medium cycle fatigue stress", which is the object of the present invention, cannot be achieved, but also it may be even deteriorated.

However, performing the above described two-stage shot peening treatment will enable to stably and easily achieve all of the conditions as the characteristics of the hardened layer portion of the surface of the above described item (B): that is, the surface roughness Rz: not more than 15 μm, σr(0): not more than −800 MPa, σr(100): not more than −800 MPa, and residual stress intensity index Ir: not less than 80000.

Hereafter, the two-stage shot peening treatment of the above described step (b) in the present invention will be described in detail.

(C-2-1) Shot Peening Treatment of the First Stage:

The shot peening treatment of the first stage in the two-stage shot peening treatment of the step (b) is performed for the purpose of causing the surface hardened layer of the carburized component to undergo plastic deformation to a deep point, to simultaneously satisfy three conditions: σr(0): not more than −800 MPa, σr(100): not more than −800 MPa, and residual stress intensity index Ir: not less than 80000. The above described shot peening treatment may be preferably performed as:

HV hardness of peening media: 650 to 750,

Average particle diameter of peening media: 0.6 to 1.0 mm, and

Coverage: not less than 500%.

If the HV hardness of the peening media is less than 650, it is difficult to cause the surface hardened layer to undergo plastic deformation up to a deep point, and there may be a case where the desired compressive residual stress cannot be provided. On one hand, if the HV hardness of the peening media exceeds 750, the surface roughness Rz of the carburized component may increase and exceed 15 μm, and thereby may be a case where the desired fatigue strength cannot be achieved. Therefore, the hardness of the peening media is preferably from 650 to 750 in HV hardness. To suppress the increase of the surface roughness Rz, the upper limit of the hardness of the peening media is more preferably 700 in HV hardness. The lower limit of the hardness of the peening media is more preferably 680 in HV hardness.

The plastic deformation region, that is, a depth from the outermost surface, which is formed when shot balls are caused to collide with the surface of the carburized component is affected by the average particle diameter of the shot balls, and the larger the average particle diameter, the deeper the plastic deformation develops from the outermost surface of the component. If the average particle diameter of the shot balls in the shot peening treatment of the first stage is less than 0.6 mm, there may be a case where σr(100) cannot be made not more than −800 MPa. On the other hand, if the average particle diameter of the shot balls exceeds 1.0 mm, the surface roughness Rz of the carburized component increases and exceeds 15 μm, there may be a case where the desired fatigue strength cannot be obtained. Therefore, the average particle diameter of the peening media may preferably be 0.6 to 1.0 mm. To suppress the increase of the surface roughness Rz of the carburized component, the upper limit of the average particle diameter of the peening media is more preferably 0.8 mm. The lower limit of the average particle diameter of the peening media is more preferably 0.65 mm.

Even if the HV hardness and the average particle diameter of the peening media are respectively 650 to 750 and 0.6 to 1.0 mm as described above, when the coverage is less than 500%, since large unevenness remains on the surface of the carburized component formed by the collision with the peening media, there may be a case where the surface roughness cannot be decreased to 15 μm or less in the surface roughness in maximum height Rz, even if the two-stage shot peening treatment is performed. Therefore, the coverage is preferably not less than 500%. The lower limit of the coverage is more preferably 550%. While increasing the coverage will allow the reduction of the surface roughness Rz, the shot peening time will increase, and therefore the upper limit of the coverage is preferably 700% from the viewpoint of productivity.

The coverage can be determined from the ratio of the sum total of the blasted area (indentation area) to the area to be subjected to shot peening of the carburized component. When the coverage per one cycle of shot peening is C1, the coverage by n cycles of shot peening is represented by $$Cn=[1-(1-C1)^n]\times 100$$

and when the calculated value reaches about 98%, this is regarded as a full coverage and is let to be 100%. Accordingly, the coverage of 500% refers to a state in which the time needed to reach the coverage of 100% is increased by 5 fold.

It is more preferable that the shot peening treatment of the first stage is performed with an arc height being 0.30 to 0.60 mmN. This is because, if the arc height is less than 0.30 mmN, there may be a case where the plastic deformation region of the surface of the carburized component becomes small so that it is unable to provide compressive residual stress up to a desired depth, and on one hand, if the arc height is greater than 0.60 mmN, although it is possible to provide compressive residual stress up to a deep point of the carburized component, there may be a case where the absolute value of the provided compressive residual stress becomes small so that the desired fatigue strength may not be achieved in either case. The lower limit of the arc height is more preferably 0.50 mmN.

(C-2-2) Shot Peening Treatment of the Second Stage:

The shot peening treatment of the second stage in the two-stage shot peening treatment of the step (b) is intended to provide compressive residual stress in the vicinity of the utmost surface of the surface hardened layer of the carburized component, which has been mainly subjected to the shot peening treatment of the first stage, by using a peening media having a smaller average particle diameter than that of the peening media of the first stage, to stably and reliably satisfy the three conditions: σr(0): not more than −800 MPa, σr(100): not more than −800 MPa, and residual stress intensity index Ir: not less than 80000, as the characteristics of the hardened layer portion of the surface of the above described item (B), and the surface roughness Rz: not more than 15 μm. The above described shot peening treatment is preferably performed as:

HV hardness of peening media: 700 to 850,

Average particle diameter of peening media: 0.05 to 0.25 mm, and

Coverage: not less than 500%.

If the HV hardness of the peening media is less than 700, it is difficult to cause the surface hardened layer to undergo plastic deformation up to a deep point, and there may be a case where the desired compressive residual stress cannot be provided. On one hand, if the HV hardness of the peening media exceeds 850, the surface roughness Rz of the carburized component may increase and exceed 15 and thereby may be a case where the desired fatigue strength cannot be achieved. Therefore, the hardness of the peening media in the shot peening treatment of the second stage is preferably 700 to 850 in HV hardness. To suppress the increase of the surface roughness Rz, the upper limit of the hardness of the peening media is more preferably 800 in HV hardness. The lower limit of the hardness of the peening media is more preferably 720 in HV hardness.

In order to provide the desired compressive residual stress in the shot peening treatment of the second stage, it is preferable to reduce the average particle diameter of shot balls in contrary to the shot peening treatment of the first stage. However, when the average particle diameter of shot balls is less than 0.05 mm, it becomes difficult to cause the surface layer portion of the carburized component to undergo plastic deformation, and there may be a case where the desired compressive residual stress cannot be provided. On the other hand, the average particle diameter of shot balls exceeds 0.25 mm, there is a case where the surface roughness Rz of the carburized component increases and exceeds 15 μm. Therefore, the average particle diameter of the peening media in the shot peening treatment of the second stage is preferably from 0.05 to 0.25 mm. To suppress the increase of the surface roughness Rz of the carburized component, the upper limit of the average particle diameter of peening media is more preferably 0.15 mm. The lower limit of the average particle diameter of the peening media is more preferably 0.08 mm.

In the shot peening treatment of the second stage as well, as in the case of the shot peening treatment of the first stage, if the coverage is less than 500%, there may be a case where the surface roughness cannot be decreased to 15 μm or less in the surface roughness in maximum height Rz. Therefore, the coverage in the shot peening treatment of the second stage is also preferably not less than 500%. The lower limit of the coverage is more preferably 550%. While increasing the coverage will allow the reduction of the surface roughness Rz, the shot peening time will increase. Therefore, the upper limit of the coverage is preferably 700% from the viewpoint of productivity.

As so far described, the coverage of 500% refers to a state where the time needed to reach the coverage of 100% is increased by 5 fold.

It is more preferable that the shot peening treatment of the second stage is performed with an arc height being 0.20 to 0.40 mmN. This is because if the arc height is less than 0.20 mmN, there may be a case where the plastic deformation region of the surface of the carburized component becomes small and it is unable to provide compressive residual stress up to a desired depth, and on the other hand, if the arc height is greater than 0.40 mmN, there may be a case where the surface roughness cannot be decreased to not more than 15 μm in terms of the surface roughness in maximum height Rz, so that the desired fatigue strength may not be achieved in either case. The lower limit of the arc height is more preferably 0.25 mmN. The upper limit of the arc height is more preferably 0.35 mmN.

Hereafter, while the present invention will be described more specifically by way of examples, the present invention will not be limited to those examples.

EXAMPLES

Steel A and steels F to N having chemical compositions shown in Table 7 were melted in a vacuum furnace to fabricate 150 kg ingots.

The steel A and steels F to K in Table 7 are steels whose chemical compositions are within the range defined in the present invention. The steels L to M are steel for comparative example in which either one of its components is out of the range of content defined in the present invention.

The steel A, which is steel corresponding to SCr420 according to the JIS G 4053 (2008), is the re-posting of the steel A in Table 1 described above.

TABLE 7

| | Chemical composition of the sample material (in mass %, balance: Fe and impurities) | | | | | | | | | | | | | | | |
|---|---|---|---|---|---|---|---|---|---|---|---|---|---|---|---|---|
| Steel | C | Si | Mn | P | S | Cr | Mo | Al | N | O | Cu | Ni | B | Ti | Nb | V |
| A | 0.21 | 0.22 | 0.84 | 0.014 | 0.016 | 1.14 | — | 0.032 | 0.018 | 0.001 | — | — | — | — | — | — |
| F | 0.18 | 0.10 | 0.86 | 0.009 | 0.014 | 0.60 | 0.20 | 0.034 | 0.008 | 0.001 | — | 0.60 | — | — | — | — |
| G | 0.21 | 0.21 | 0.84 | 0.014 | 0.016 | 1.14 | — | 0.032 | 0.006 | 0.001 | 0.02 | 0.03 | — | — | — | — |
| H | 0.22 | 0.15 | 0.70 | 0.010 | 0.015 | 0.15 | — | 0.025 | 0.006 | 0.001 | — | — | 0.0020 | 0.037 | — | — |
| I | 0.20 | 0.09 | 0.69 | 0.015 | 0.010 | 1.05 | 0.37 | 0.032 | 0.012 | 0.001 | — | — | — | — | 0.035 | — |
| J | 0.20 | 0.20 | 0.80 | 0.015 | 0.020 | 0.07 | — | 0.030 | 0.004 | 0.001 | — | — | — | — | — | 0.30 |
| K | 0.21 | 0.07 | 0.65 | 0.010 | 0.020 | 1.80 | — | 0.033 | 0.007 | 0.001 | — | — | 0.0015 | 0.035 | 0.037 | — |
| L | *0.12 | 0.12 | 0.82 | 0.010 | 0.015 | 0.16 | — | 0.030 | 0.008 | 0.001 | — | — | 0.0014 | 0.032 | — | — |
| M | 0.21 | 0.20 | *0.30 | 0.014 | 0.015 | 1.05 | — | 0.032 | 0.006 | 0.001 | 0.02 | 0.03 | — | — | — | — |
| N | 0.20 | 0.20 | *1.80 | 0.010 | 0.014 | 1.50 | 0.20 | 0.032 | 0.006 | 0.001 | 0.02 | 0.03 | — | — | — | — |

*indicates that chemical composition does not satisfy the range defined by the present invention.

The each steel ingot described above was heated to 1250° C. and thereafter was hot forged into a round bar with a diameter of 30 mm. The cooling of the round bar after the hot forging was conducted by allowing it to cool in the atmosphere.

Next, the round bar with a diameter of 30 mm, which was obtained by hot forging, was subjected to a normalizing treatment in which the round bar was held and soaked at a heating temperature of 900° C. for 60 min, and thereafter allowed to cool in the atmosphere.

A rectangular parallelepiped having a cross section of 13 mm×13 mm and a length of 100 mm was cut out by machining from the central portion of the normalized round bar with a diameter of 30 mm, and thereafter a semicircular notch of a radius of 2 mm was further provided at a middle location in the longitudinal direction of one surface of the above described rectangular parallelepiped to fabricate a four-point bending specimen.

Next, as the "carburizing and quenching" for each steel described above, the four-point bending specimen was subjected to a carburizing treatment with the soaking temperature being 930° C., and thereafter was put into oil of 120° C. After the carburizing and quenching was performed, a tempering treatment is carried out in which the specimen was further soaked at a heating temperature of 180° C. for 120 min, and thereafter was allowed to cool in the atmosphere.

Table 8 shows details of the carburizing conditions. "Cp1" and "Cp2" in Table 8 represent "carbon potentials" in the carburizing treatment, and carburizing was performed first at the condition of Cp1 for the time shown in "soaking time 1", and then at the condition of Cp1 for the time shown in "soaking time 2".

In Table 8, the treatment of test number 17 of Table 3 described above, in which the steel A was subjected to a treatment at a typical "carburizing and quenching-tempering" condition, is re-posted. In Table 8 as well, for the treatment of test number 17, description of the treatment to "temporarily cool the specimen to 870° C. and further hold it at that temperature for 60 min while keeping the carbon potential at 0.8%" is omitted, as in the case of Table 3.

TABLE 8

| | | Carburizing Conditions | | | | | HV hardness | | |
|---|---|---|---|---|---|---|---|---|---|
| | | Soaking | | Soaking | | Soaking | | | |
| Test No. | Steel | Temp. (° C.) | Cp1 (%) | Time 1 (min) | Cp2 (%) | Time 2 (min) | surface hardness | core hardness | C(ave) (%) |
| 17 | A | 930 | #1.1 | 100 | 0.8 | 50 | 765 | 395 | 0.80 |
| 18 | A | 930 | 0.7 | 140 | 0.5 | 90 | 630 | 395 | 0.51 |
| 19 | A | 930 | 0.7 | 140 | 0.5 | 90 | 630 | 395 | 0.51 |
| 20 | A | 930 | 0.7 | 140 | 0.5 | 90 | 630 | 395 | 0.51 |
| 21 | A | 930 | 0.7 | 140 | 0.5 | 90 | 630 | 395 | 0.51 |
| 22 | A | 930 | 0.7 | 140 | 0.5 | 90 | 630 | 395 | 0.51 |
| 23 | A | 930 | 0.7 | 140 | 0.5 | 90 | 630 | 395 | 0.51 |
| 24 | A | 930 | 0.7 | 140 | 0.5 | 90 | 630 | 395 | 0.51 |
| 25 | F | 930 | 0.7 | 130 | 0.45 | 90 | 625 | 375 | 0.47 |
| 26 | G | 930 | 0.7 | 100 | 0.4 | 80 | 620 | 408 | 0.39 |
| 27 | H | 930 | 0.7 | 130 | 0.45 | 90 | 625 | 418 | 0.46 |
| 28 | I | 930 | 0.7 | 100 | 0.6 | 70 | 710 | 397 | 0.59 |
| 29 | J | 930 | 0.7 | 90 | 0.4 | 90 | 603 | 397 | 0.41 |
| 30 | K | 930 | 0.7 | 90 | 0.55 | 70 | 670 | 408 | 0.54 |
| 31 | A | 930 | 0.7 | 140 | 0.5 | 90 | 630 | 395 | 0.51 |
| 32 | A | 930 | 0.7 | 140 | 0.5 | 90 | 630 | 395 | 0.51 |
| 33 | A | 930 | 0.7 | 140 | 0.5 | 90 | 630 | 395 | 0.51 |
| 34 | A | 930 | 0.7 | 140 | 0.5 | 90 | 630 | 395 | 0.51 |
| 35 | A | 930 | 0.7 | 140 | 0.5 | 90 | 630 | 395 | 0.51 |
| 36 | A | 930 | 0.7 | 140 | 0.5 | 90 | 630 | 395 | 0.51 |
| 37 | A | 930 | 0.7 | 140 | 0.5 | 90 | 630 | 395 | 0.51 |
| 38 | A | 930 | 0.7 | 140 | 0.5 | 90 | 630 | 395 | 0.51 |
| 39 | *L | 930 | 0.7 | 140 | 0.5 | 90 | 630 | 305 | 0.51 |
| 40 | *M | 930 | 0.7 | 100 | 0.4 | 80 | 620 | 408 | 0.39 |
| 41 | *N | 930 | 0.7 | 100 | 0.6 | 70 | 710 | 397 | 0.59 |

*indicates that chemical composition does not satisfy the range defined by the present invention.
#indicates that carburizing conditions do not satisfy those defined by the present invention.

The four-point bending specimen which had undergone the above described "carburizing and quenching-tempering" treatment was used to investigate the hardness and the carbon concentration distribution.

As for hardness, HV hardness was measured after the four-point bending specimen was embedded in resin and ground such that the cross section at the location where the semicircular notch was provided was able to be investigated. The HV hardness test was conducted by the method defined in JIS Z 2244 (2009) with the test force being 2.94 N, and the core hardness and the surface hardness were determined.

The core hardness was represented by an average value of measurements of 5 points at a depth of 10 mm from a reference surface which was the surface where a semicircle notch was provided and which made up one side of the cross section of the specimen embedded in the resin.

The surface hardness was represented by an average value of measurements of 5 points at a depth of 0.05 mm from a reference surface which was the surface where the above described semicircular notch was provided.

The carbon concentration distribution was determined as follows. First, as well as in the above described hardness measurement, the four-point bending specimen was embedded in resin and ground such that the cross section at the location where the semicircular notch was provided was able to be investigated. Thereafter, with the notched bottom being the outermost surface, the carbon concentration distribution in the direction toward the center of the specimen was measured with a calibration line by using a wavelength dispersive EPMA apparatus. Next, using the above described measurement result, C(ave) which is an average carbon concentration in the region from the outermost surface to a point of 0.2 mm depth in the direction toward the center was determined according to the above described equation: $[5\times\int C(x)dx]$.

The surface hardness, the core hardness, and C(ave), which were determined as described above, are shown in Table 8.

A two-stage shot peening treatment was carried out, at the conditions shown in Table 9, on the surface provided with the semicircular notch, for the four-point bending specimens which had undergone the "carburizing and quenching-tempering" treatment of test numbers 17 to 30 and test numbers 33 to 41 shown in Table 8.

In the case of the four-point bending specimen which had undergone the "carburizing and quenching-tempering" treatment of test number 31 shown in Table 8, only the shot peening treatment of the first stage shown in Table 9 was carried on the surface provided with the semi-circular notch, and no shot peening treatment was carried out on the four-point bending specimen which had undergone the "carburizing and quenching-tempering" treatment of test number 32. Also shown for comparison in table 9 is treatment condition of test number 17 which was shown in Table 3.

TABLE 9

| | | Shot peening treatment of the first stage | | | | | Shot peening treatment of the second stage | | | | |
|---|---|---|---|---|---|---|---|---|---|---|---|
| | | Blast media | | Blasting conditions | | | Blast media | | Blasting conditions | | |
| Test No. | Steel | HV hardness | Average particle diameter (μm) | Blasting time (s) | Blasting air pressure (MPa) | Coverage (%) | HV hardness | Average particle diameter (μm) | Blasting time (s) | Blasting air pressure (MPa) | Coverage (%) |
| 17 | A | #— | #— | — | — | — | #— | #— | — | — | — |
| 18 | A | 700 | 0.6 | 12 | 0.2 | 500 | 800 | 0.1 | 20 | 0.2 | 500 |
| 19 | A | 700 | 0.9 | 12 | 0.2 | 500 | 800 | 0.1 | 20 | 0.2 | 500 |
| 20 | A | 660 | 0.6 | 15 | 0.35 | 500 | 800 | 0.1 | 20 | 0.2 | 500 |
| 21 | A | 740 | 0.6 | 10 | 0.35 | 500 | 800 | 0.1 | 20 | 0.2 | 500 |
| 22 | A | 700 | 0.6 | 21 | 0.2 | 700 | 800 | 0.1 | 20 | 0.2 | 500 |
| 23 | A | 700 | 0.6 | 12 | 0.2 | 500 | 800 | 0.1 | 28 | 0.2 | 700 |
| 24 | A | 700 | 0.6 | 12 | 0.2 | 500 | 800 | 0.2 | 25 | 0.2 | 500 |
| 25 | F | 700 | 0.6 | 12 | 0.35 | 600 | 800 | 0.1 | 20 | 0.2 | 500 |
| 26 | G | 680 | 0.6 | 15 | 0.35 | 500 | 720 | 0.1 | 20 | 0.2 | 500 |
| 27 | H | 700 | 0.6 | 12 | 0.35 | 600 | 800 | 0.1 | 20 | 0.2 | 500 |
| 28 | I | 740 | 0.6 | 10 | 0.35 | 500 | 820 | 0.1 | 24 | 0.2 | 600 |
| 29 | J | 700 | 0.6 | 12 | 0.2 | 500 | 800 | 0.1 | 20 | 0.2 | 500 |
| 30 | K | 700 | 0.6 | 12 | 0.35 | 600 | 800 | 0.1 | 20 | 0.2 | 500 |
| 31 | A | 700 | 0.6 | 12 | 0.2 | 500 | #— | #— | — | — | — |
| 32 | A | #— | #— | — | — | — | #— | #— | — | — | — |
| 33 | A | 700 | 0.6 | 4.8 | 0.2 | 200 | 800 | 0.1 | 20 | 0.2 | 500 |
| 34 | A | 700 | #1.5 | 10 | 0.2 | 500 | 800 | 0.1 | 20 | 0.2 | 500 |
| 35 | A | 700 | 0.6 | 12 | 0.2 | 500 | 800 | #0.4 | 25 | 0.2 | 500 |
| 36 | A | #600 | 0.6 | 20 | 0.35 | 500 | 800 | 0.1 | 25 | 0.2 | 500 |
| 37 | A | #820 | 0.6 | 10 | 0.2 | 500 | 800 | 0.1 | 25 | 0.2 | 500 |
| 38 | A | 700 | 0.6 | 12 | 0.2 | 500 | #900 | 0.2 | 15 | 0.2 | 500 |
| 39 | *L | 700 | 0.6 | 12 | 0.2 | 500 | 800 | 0.1 | 20 | 0.2 | 500 |
| 40 | *M | 700 | 0.6 | 12 | 0.35 | 500 | 800 | 0.1 | 20 | 0.2 | 500 |
| 41 | *N | 700 | 0.6 | 12 | 0.35 | 500 | 800 | 0.1 | 20 | 0.2 | 500 |

"—" of the test number 17, 31 and 32 indicates that shot peening treatment is not carried out.
*indicates that chemical composition does not, satisfy the range defined by the present invention.
#indicates that shot peening conditions do not satisfy those defined by the present invention.

The four-point bending specimens of test numbers 18 to 41, which had undergone the above described treatments, were used to investigate σr(0), σr(100), residual stress intensity index Ir, and the surface roughness in maximum height Rz defined in JIS B 0601 (2001) were investigated. The specimen was ground from the surface to the point of a predetermined depth by electrolytic grinding and the intensity of diffracted X-ray was measured at each depth point, and σr(0) and σr(100) on the surface of the semi-circle notched bottom were determined from the relationship between the half-value width of a peak intensity and the peak central position obtained by the measurement.

The residual stress intensity index Ir was determined by measuring the compressive residual stress at each point of 0 μm, 10 μm, 30 μm, 50 μm, 80 μm, and 100 μm depths in the method shown in (1) to (8) as already described.

Next, using four-point bending specimens of test numbers 18 to 41 which had undergone the above described treatments, a four-point bending fatigue test was conducted at the following conditions:

Stress ratio: 0.1,

Inter-fulcrum distance: 45 mm, and

Test frequency: 5 Hz.

In the four-point bending fatigue test, a crack initiation strength at a number of cycles of $5\times10^3$ were evaluated as the "bending fatigue strength".

The target for the improvement of the bending fatigue strength was set to be an improvement of not less than 50% with reference to the bending fatigue strength of test number 17, that is, the bending fatigue strength when steel A corresponding to SCr420, which was typical as the case hardening steel, was used and subjected to the bending fatigue test as treated with the "carburizing and quenching-tempering" treatment at a common condition.

Results of the above described each test are shown in Table 10. Also shown for comparison in Table 10 are test results of test number 17 which was shown in Table 6. Table 10 also shows improvement rates of bending fatigue strength with reference to the bending fatigue strength of test number 17.

TABLE 10

| | | | | | | | Bending Fatigue Properties | |
|---|---|---|---|---|---|---|---|---|
| | | | | Residual Stress | | | Bending | Improvement |
| | Test No. | Steel | Surface Roughness Rz (μ) | σr(0) (MPa) | σr(100) (MPa) | Residual Stress Intensity Index Ir (MPa · μm) | Fatigue Strength (MPa) | Rates of Bending Fatigue Strength (%) |
| ref. | 17 | A | 12.20 | *−100 | 0 | *6000 | 753 | — |
| Examples | 18 | A | 8.30 | −1080 | −1130 | 110000 | 1220 | 62 |
| of the | 19 | A | 8.60 | −1082 | −1170 | 112500 | 1225 | 63 |
| present | 20 | A | 6.35 | −1070 | −1020 | 105000 | 1140 | 51 |

TABLE 10-continued

| | Test No. | Steel | Surface Roughness Rz (μ) | Residual Stress σr(0) (MPa) | Residual Stress σr(100) (MPa) | Residual Stress Intensity Index Ir (MPa · μm) | Bending Fatigue Properties: Bending Fatigue Strength (MPa) | Bending Fatigue Properties: Improvement Rates of Bending Fatigue Strength (%) |
|---|---|---|---|---|---|---|---|---|
| invention | 21 | A | 8.65 | −1100 | −1195 | 115000 | 1240 | 65 |
| | 22 | A | 8.25 | −1090 | −1125 | 111000 | 1230 | 63 |
| | 23 | A | 6.41 | −1095 | −1110 | 109000 | 1195 | 59 |
| | 24 | A | 9.25 | −985 | −1110 | 108000 | 1190 | 58 |
| | 25 | F | 10.20 | −990 | −1000 | 99500 | 1240 | 65 |
| | 26 | G | 11.00 | −1050 | −1075 | 106000 | 1280 | 70 |
| | 27 | H | 10.60 | −1050 | −1050 | 105000 | 1320 | 75 |
| | 28 | I | 7.00 | −1100 | −1150 | 113500 | 1160 | 54 |
| | 29 | J | 6.95 | −1025 | −1160 | 110000 | 1285 | 71 |
| | 30 | K | 6.90 | −1100 | −1160 | 115000 | 1205 | 60 |
| Comparative Examples | 31 | A | 12.00 | *−570 | −1070 | 85000 | 980 | $30 |
| | 32 | A | 3.40 | *−110 | *0 | *7000 | 940 | $25 |
| | 33 | A | *18.00 | −850 | −980 | 92500 | 850 | $13 |
| | 34 | A | *16.00 | −900 | −1050 | 93500 | 865 | $15 |
| | 35 | A | *16.00 | *−750 | −1010 | 82000 | 840 | $12 |
| | 36 | A | 7.00 | −1050 | *−720 | 83500 | 870 | $16 |
| | 37 | A | *21.00 | −1100 | −1010 | 112000 | 820 | $ 9 |
| | 38 | A | *17.50 | −1080 | −1010 | 115000 | 1035 | $37 |
| | 39 | *L | 8.00 | −850 | −920 | 88000 | 910 | $21 |
| | 40 | *M | 10.00 | −1050 | *−750 | 81000 | 1080 | $43 |
| | 41 | *N | *17.00 | −1080 | −1150 | 113500 | 1020 | $35 |

"ref." indicates that reference value of bending fatigue strength, and "improvement rates of bending fatigue strength" is based on the reference value of the bending fatigue strength of test number 17.
*indicates that conditions do not satisfy those defined by the present invention.
$indicates that the target bending fatigue strength is not achieved.

From Table 10, the bending fatigue strengths of test numbers 18 to 30, which satisfied the conditions defined in the present invention, were increased by not less than 50% from the bending fatigue strength of test number 17 which utilized steel A corresponding to SCr420 that was common as the case hardening steel, and which was subjected to a carburizing and quenching-tempering at a conventionally common condition, and thus it is clear that the fatigue strength in the "low to medium cycle region" is significantly improved compared with that of a conventional carburized and quenched-tempered component.

In contrast, in the case of test numbers which deviated from the conditions defined in the present invention, the target bending fatigue strength has not been achieved.

That is, in the case of test number 31, σr(0) was −570 MPa and was larger than the upper limit value −800 MPa defined in the present invention. For this reason, the targeted improvement of fatigue strength was not observed.

In the case of test number 32, both of the values of σr(0) and σr(100), which are residual stress, were larger than the upper limit value −800 MPa defined in the present invention, and moreover the residual stress intensity index Ir was 7000 which was smaller than the lower limit value 80000 defined in the present invention. For this reason, the targeted improvement of fatigue strength was not observed.

In the cases of test numbers 33, 34, 37, and 38, the surface roughness Rz respectively exhibited 18.00 μm, 16.00 μm, 21.00 μm, and 17.50 μm, each of which was larger than the upper limit value defined in the present invention. For this reason, improvement of fatigue strength was not observed in any of the cases.

In the case of test number 35, the surface roughness Rz was 16.00 μm which was large as well, and moreover the value of residual stress σr(0) was −750 MPa which was larger than the upper limit value −800 MPa defined in the present invention. For this reason, the targeted improvement of fatigue strength was unable to be achieved.

In the case of test number 36, the value of residual stress σr(100) was −720 MPa which was larger than the upper limit value −800 MPa defined in the present invention. For this reason, the targeted fatigue strength was not achieved.

In the case of test number 39, the C content of steel L was 0.12% which was lower than the lower limit value 0.15% defined in the present invention. For this reason, the core hardness declined, and no improvement in fatigue strength was observed.

In the case of test number 40, since the Mn content of steel M was 0.30% which was lower than the condition defined in the present invention, the value of residual stress σr(100) exhibited −750 MPa which was larger than the upper limit value −800 MPa defined in the present invention, and a sufficient compressive residual stress was not ensured at a deep location. For this reason, the targeted fatigue strength was not achieved.

In the case of test number 41, since the Mn content of steel N was 1.80% which exceeded the condition defined in the present invention, the surface roughness Rz was 17.00 μm which was larger than the upper limit value defined in the present invention. For this reason, no improvement in fatigue strength was observed.

Industrial Applicability

The fatigue strength in the "low to medium cycle region" of the carburized components of the present invention has been significantly improved compared with that of the components subjected to a conventional carburizing and quenching-tempering treatment. Therefore, the carburized components of the present invention are suitable for uses as various shafts or power transmission parts for automobiles, construction machines, industrial machines, and the like, which may be subjected to impulsive and relatively large loading.

The invention claimed is:

1. A carburized component made of steel, wherein base steel is a steel having a chemical composition containing, by mass %, C: 0.15 to 0.25%, Si: 0.03 to 0.50%, Mn: more than 0.60% and not more than 1.5%, P: not more than 0.015%, S: 0.006 to 0.030%, Cr: 0.05 to 2.0%, Al: not more than 0.10%, N: not more than 0.03%, O: not more than 0.0020%, and at least one element selected from Cu: 0.05 to 1.0%, Ni: 0.05 to 3.0%, and B: 0.0005 to 0.0030%, the balance being Fe and impurities, wherein a surface hardened layer portion satisfies following conditions of (a) to (c):

(a) C(ave): by mass %, 0.35 to 0.60%, (b) surface roughness Rz: not more than 15 μm, and (c) σr(0): not more than −800 MPa, σr(100): not more than −800 MPa, and residual stress intensity index Ir: not less than 80000, wherein;

C(ave) is an average carbon concentration in the region from the outermost surface to a point of 0.2 mm depth, the surface roughness Rz refers to the surface roughness in maximum height defined in JIS B 0601 (2001), σr(0) refers to the compressive residual stress at the outermost surface of the component, and σr(100) to the compressive residual stress at a point 100 μm from the outermost surface of the component, the residual stress intensity index Ir is calculated by [$Ir = \int|\sigma r(y)|dy$], where y μm is the depth from the outermost surface and σr(y) is the residual stress for the points from the outermost surface to a depth of 100 μm, here, the integration interval, that is, the range of "y" is 0 to 100 (μM).

2. The carburized component according to claim 1, wherein the base steel is a steel further comprising, by mass %, Mo: less than 0.50%.

3. The carburized component according to claim 1, wherein the base steel is a steel further comprising at least one element selected from, by mass %, Ti: not more than 0.10%, Nb: not more than 0.10%, and V: not more than 0.30%.

4. The carburized component according to claim 2, wherein the base steel is a steel further comprising at least one element selected from, by mass %, Ti: not more than 0.10%, Nb: not more than 0.10%, and V: not more than 0.30%.

* * * * *

UNITED STATES PATENT AND TRADEMARK OFFICE

CERTIFICATE OF CORRECTION

PATENT NO. : 8,961,710 B2
APPLICATION NO. : 13/304733
DATED : February 24, 2015
INVENTOR(S) : Neishi et al.

It is certified that error appears in the above-identified patent and that said Letters Patent is hereby corrected as shown below:

Title page, item (57) Abstract Line 12:
Ir≤80000, wherein Ir is calculated by [Ir = ∫|σr(y)|dy], where y
should read:
Ir≥80000, wherein Ir is calculated by [Ir = ∫|σr(y)|dy], where y Signed and Sealed this
Thirteenth Day of October, 2015

Michelle K. Lee

Michelle K. Lee
*Director of the United States Patent and Trademark Office*